US012508645B2

(12) United States Patent
Cosby

(10) Patent No.: US 12,508,645 B2
(45) Date of Patent: Dec. 30, 2025

(54) ARTICLE BENDER APPARATUS

(71) Applicant: Joshua Cosby, Falfurrias, TX (US)

(72) Inventor: Joshua Cosby, Falfurrias, TX (US)

( * ) Notice: Subject to any disclaimer, the term of this patent is extended or adjusted under 35 U.S.C. 154(b) by 134 days.

(21) Appl. No.: 18/592,562

(22) Filed: Mar. 1, 2024

(65) Prior Publication Data

US 2024/0198411 A1 Jun. 20, 2024

Related U.S. Application Data

(63) Continuation-in-part of application No. 17/985,890, filed on Nov. 13, 2022, now Pat. No. 11,945,022.

(60) Provisional application No. 63/286,103, filed on Dec. 6, 2021.

(51) Int. Cl.
*B21F 15/04* (2006.01)

(52) U.S. Cl.
CPC ..... *B21F 15/04* (2013.01)

(58) Field of Classification Search
CPC ..... B21F 7/00; B21F 15/04; E04H 17/268; B25B 25/00
See application file for complete search history.

(56) References Cited

U.S. PATENT DOCUMENTS 1,633,401 A * 6/1927 Fisher ..... B21F 15/04 140/117
1,651,210 A * 11/1927 Kersey ..... B21F 15/04 140/122
2,611,397 A * 9/1952 Limpus ..... B25B 7/02 140/117
3,297,060 A * 1/1967 Richardson ..... B21F 15/04 140/123
3,624,888 A * 12/1971 Kester ..... H01R 43/0335 29/751
3,990,486 A * 11/1976 Quick ..... B21F 7/00 140/149
4,421,145 A * 12/1983 Broberg, Jr. ..... B21F 45/00 140/123
2020/0056678 A1* 2/2020 Fox ..... F16G 11/12
2020/0070236 A1* 3/2020 Scherbakov ..... B21F 7/00
2020/0102105 A1* 4/2020 Seesing ..... B21F 33/02

* cited by examiner

*Primary Examiner* — Bobby Yeonjin Kim

(74) *Attorney, Agent, or Firm* — Roger A. Jackson

(57) ABSTRACT

An article bender apparatus that assists in joining two separate malleable article line free ends in a selected helical wrap, the article bender apparatus including a disc that has a slot disposed therethrough that originates from the center at a root extending radially outward, a shoe having a selectable pivotal lock to a face of the disc, wherein the shoe is in an open state when the slot is open and the shoe is in a closed locked state when the shoe partially covers the slot leaving the slot root section open. Also, a means for rotating the disc about the root, operationally the disc is inserted onto a first line free end portion to the root, the shoe is placed in the closed locked state, with the shoe intersecting a second line free end portion, next rotating the disc to helically wrap the second line about the first line.

17 Claims, 33 Drawing Sheets

ARTICLE BENDER APPARATUS

CROSS-REFERENCE TO RELATED APPLICATIONS

This application is a continuation in part (CIP) patent application of U.S. patent application Ser. No. 17/985,890 filed on Nov. 13, 2022 by Joshua Cosby of Falfurrias, Texas, U.S., that claims the benefit of U.S. provisional patent application Ser. No. 63/286,103 filed on Dec. 6, 2021 by Joshua Cosby of Falfurrias, Texas, U.S.

BACKGROUND OF INVENTION

The present invention relates generally to an article bender apparatus, which is employed to assist in joining two separate malleable article line free ends via bending and wrapping the article free ends together. More particularly, the present invention of the article bender apparatus manually joins a first line free end portion and a second line free end portion that are at substantially right angles to one another, wherein the second article free end portion is selectively helically wrapped about the first line free end portion.

It is frequently needed on farms and ranches to manually install or repair fences, wherein it is required to join pre-made fencing sections that come rolled and when unrolled each end needs to be joined, which can actually be simply done with pliers, however, to increase the ease and speed of joining the first and second line free ends, a dedicated tool is better that can accommodate different size lines (diameter wise), help make the mechanical advantage better for easier wire bending via multiple handle positioning, ratchets, and the like.

PRIOR ART

Thus, the prior art recognizes these issues with various apparatus and devices that assist the individual in tying fence wire ends together. Looking at the prior art in this area in U.S. Pat. No. 3,297,060 to Richardson, disclosed is a wire splicer that includes a ratchet type head assembly with a handle, and within the head assembly is a disc with a slot that captures a first wire with the disc having an axial extension having a slot that captures a second wire. In Richardson, in looking at FIG. 4 it looks as though the second wire must be positioned at an angle to the first wire, as opposed to the standard practice of the first and second wire being at about right angles to one another.

Continuing in the prior art for wire tying tools, in U.S. Pat. No. 1,861,308 to Goldenstar, disclosed is a wire tying tool that also has a ratchet head assembly having a disc with a slot, with a handle extending from the head assembly, wherein a jaw (29) projects from the head assembly axially to encompass the second wire at more or less at a right angle to the first wire, it is not apparent that the wire size is adjustable or that the first wire is secured within the disc.

Further, in the prior art for wire twisters and splicers, in U.S. Pat. No. 756,148 to Simpson, disclosed is a wire twister/splicer that includes again a ratchet head and handle extending therefrom, wherein the ratchet head has slot to receive the first wire, with the head having an encapsulated slot extending axially to hold the second wire, with a pivoting cover to hold the second wire in the slot that does allow the second wire to be at a right angle to the first wire, but not accommodating different wire sizes or helical wrap axial clearance.

Next, a wire splicer is disclosed in U.S. Pat. No. 2,153,079 to Featherston, that as in the prior examples in the prior art, has a ratchet head with a handle extending therefrom with a fixed slot in the head for the first wire with a pivoting shoe portion that encompasses the second wire, however, it looks as though the shoe would not provide adequate clearance for succeeding axial helical wraps, see FIG. 6, again it does not look like different wire sizes are accommodated easily either.

Moving onward, in the wire splicer arts in U.S. Pat. No. 1,129,711 to Mumford, disclosed is a ratchet head with a handle extending therefrom with a slot in the head for the first wire with a slotted barrel to accommodate the second wire, however, it looks as though the barrel shape would not provide adequate axial clearance for succeeding helical wraps, plus the slotted barrel looks oversize to accommodate larger second wires, but this would make it difficult to helically wrap smaller second wires axially adjacent to one another.

Next, a wire splicer is disclosed in U.S. Pat. No. 374,650 to Batters, that is a simple one-piece device with essentially a hook at the end of a handle that requires a clamping wrench to hold the first wire and second wire parallel to one another prior to winding.

Continuing, a wire splicer is disclosed in U.S. Pat. No. 868,178 to Goughnour, that is similar to Featherston and Mumford, as Goughnour plus as in the prior examples in the prior art has a ratchet head with a handle extending therefrom with a slot in the head for the first wire with a slotted barrel to accommodate the second wire, however, it looks as though the slotted barrel would not provide adequate clearance for succeeding axial helical wraps, again it does not look like different wire sizes are accommodated easily.

Further, a wire splicer is disclosed in U.S. Pat. No. 1,754,023 to Jones, that discloses a wire splicer that includes a pivot squeeze handle for encompassing the first wire, wherein the handle is used in a swing around manner to make the helical wrap of the second wire about the first wire, wherein a lug (30) with grooves accommodates the second wire for bending about the first wire, again it does not look like different wire sizes are accommodated easily.

What is needed is an article bender apparatus that has several improvements over the prior art that include the ability to accommodate different wire sizes with precision for axially winding the helical wrap with a professional appearance, also a second wire guide shoe that provides an operational clearance both axially and radially for subsequent helical wraps to make professional helical wraps of the second wire about he first wire in a sequential manner.

SUMMARY OF THE INVENTION

An article bender apparatus that assists in joining two separate malleable article line free ends that are defined as a first line free end portion with a first line long axis and a second line free end portion with a second line long axis when the first and second line long axes are positioned substantially perpendicular to one another, the article bender apparatus assists in joining the first and second line free end portions in a selected helical wrap. The article bender apparatus including a disc having a first face portion and an opposing second face portion, further the disc having an outer periphery portion that is about a longitudinal axis that is centered in the disc, wherein the longitudinal axis is positioned perpendicular to both the first and second face portions, in addition the disc has a slot disposed therethrough from the first face portion to the second face portion, wherein the slot originates from the longitudinal axis in a root section then extending in a radial fashion to the outer periphery portion of the disc.

Further included in the article bender apparatus is a shoe that is planar in shape having a primary planar face portion and an opposing secondary planar face portion, the shoe has a lengthwise axis and a perpendicularly positioned shortwise axis, the shoe also has a first end portion and an opposing second end portion with the lengthwise axis spanning therebetween, further the shoe has an axial axis that is perpendicular to both the lengthwise and shortwise axes, wherein the axial axis spans between the primary and secondary planar face portions, also the axial axis is positioned parallel to the disc longitudinal axis with the primary planar face portion having a slidable engagement to the disc first face portion, the shoe first end portion terminates in a first channel that is positioned longwise to be parallel to the shortwise axis.

Additionally included in the article bender apparatus is a means for a selectable pivotal lock with pivotal movement between the disc and the shoe, the pivotal lock is about the axial axis, wherein the shoe is an open operational state when the slot is fully open and the shoe is in a closed locked operational state when the shoe partially covers the slot leaving the slot root section open.

Also included in the article bender apparatus is a means for imparting a rotational movement to the disc, wherein the rotational movement is about the longitudinal axis, wherein operationally the disc is inserted onto the first line free end portion with the first line long axis therethrough the disc slot from the outer periphery portion to the root section resulting in the longitudinal axis and the first line long axis being substantially co-incident to one another, next the shoe is manually moved through the pivotal movement from the open state to the closed locked state resulting in the first line free end portion being secured within the root section. Continuing simultaneously during the shoe being manually moved, the first channel is aligned to partially encompass the second line free end portion, resulting in both the first line free end portion being secured within the root section and the shoe first channel to partially encompass the second line free end portion, next the imparting of rotational movement to the disc is initiated to result in the selected helical wrap of the second line free end portion around the first line free end portion being about the first line long axis.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 6 shows an opposing side elevation view of FIG. 5, wherein FIG. 6 shows the disc with the slot and slot root section, wherein also shown is the cam lock clamp with the quick release handle being shown on the disc in the locked or closed operational state with the quick release handle being adjacent to the disc first face portion, also shown is the flat spring handle with the pivot rod and the pivot rod aperture, plus the handle ball protrusion and the receiving depression for the handle ball protrusion that through pivot rod pivotal movement secures the pivot rod in a locked position for the flat spring (not shown);

FIG. 7 shows the side elevation view of FIG. 6, however, with the flat spring handle moved into the locked position, wherein FIG. 7 shows the disc with the slot and slot root section, wherein also shown is the cam lock clamp with the quick release handle being shown on the disc in the locked or closed operational state with the quick release handle being adjacent to the disc first face portion, also shown is the flat spring handle with the pivot rod and the pivot rod aperture, plus the handle ball protrusion and the receiving depression connected for locking the flat spring handle that through pivot rod pivotal movement secures the pivot rod in a locked position for the flat spring (not shown);

FIG. 8 is a front perspective view of FIG. 5, wherein FIG. 8 shows the disc with the slot and slot root section, wherein also shown is the shoe and the angularly displaced retainer bar that are both pivotally attached by the axial pivot bolt, further shown in FIG. 8 is the retainer bar stop pin, the flat spring with the pivot rod and the pivot rod aperture;

FIG. 9 shows the side elevation view of FIG. 5, wherein FIG. 9 shows the flat spring pivoted through pivotal movement being moved downward away from the disc slot and disc slot root section, wherein also shown is the shoe and the angularly displaced retainer bar that are both pivotally attached by the axial pivot bolt, with the shoe and retainer bar pivotally moved past the slot root section, further shown in FIG. 9 is the retainer bar stop pin, and the flat spring with the pivot rod and the pivot rod aperture;

FIG. 10 shows the side elevation view of FIG. 5, wherein FIG. 10 shows a lower perspective view of the disc with the slot and slot root section, wherein also shown is the shoe and the angularly displaced retainer bar that are both pivotally attached by the axial pivot bolt, further shown in FIG. 10 is the retainer bar stop pin, the flat spring with the pivot rod and the pivot rod aperture, in addition to the flat spring handle;

FIG. 15 is view 15-15 from FIG. 13, wherein FIG. 15 shows the first channel and first ridge with their associated chamfers being chamfers disposed on the first ridge and chamfer disposed on the first channel;

FIG. 17 shows the side elevation view of FIG. 16, except wherein FIG. 17 shows the ratchet in the second operational state with the pawl asymmetrical gear teeth disengaged to the disc outer periphery and asymmetrical gear teeth thus allowing free rotation of the receptacle handle counterclockwise about the longitudinal axis and the disc free rotation clockwise about the longitudinal axis, wherein the pawl is moved away from the arcuate convergence against the means for biasing the pawl by the aforementioned relative asymmetrical gear teeth movement of the pawl and disc, further FIG. 17 shows the side elevation cutaway view of the receptacle with partial handle, with the receptacle having the cover ring removed to expose the disc with the outer periphery portion having the asymmetrical gear teeth wherein the disc outer periphery and asymmetrical gear teeth are slidably disengaged, with the slide surface and the radial internal diameter plus the internal diameter to have the disc retained within the receptacle;

FIG. 20 is view 20-20 from FIG. 18, wherein FIG. 20 shows detail of the receptacle, cover ring, and disc outer periphery asymmetric gear teeth slidable interface along with the internal diameter of the receptacle, slide surface of the receptacle, the top surface of the receptacle, and internal diameter of the cover ring;

FIG. 24 shows a disc side elevation view and a shoe and retainer bar end view of FIG. 23, wherein FIG. 24 shows the first line in the root section of the slot of the disc retained by the retainer bar with the shoe and the retainer bar in the closed operational state that helps position the first channel to the second line free end portion, further shown is the shoe first channel partially encompassing the second line and being held in place by the flat spring applying pressure onto the second line into the first channel of the shoe, wherein with the manual rotation of the disc the shoe first channel will wrap the second line helically about the first line, note that for pictorial clarity the ratchet, receptacle, and receptacle handle are not shown;

FIG. 25 shows a lower perspective view of FIG. 24, wherein FIG. 25 shows a disc bottom view and a shoe and retainer bar bottom view of FIG. 24, wherein FIG. 25 shows the first line in the root section of the slot of the disc contacted by the retainer bar with the shoe and the retainer bar in the closed operational state, further shown is the shoe first channel partially encompassing the second line and being held in place by the flat spring applying pressure onto the second line into the first channel of the shoe, wherein with the manual rotation of the disc the shoe first channel will wrap the second line helically about the first line, note that for pictorial clarity the ratchet, receptacle, and receptacle handle are not shown;

FIG. 31 is taken from cross section 31-31 from FIG. 17, wherein FIG. 31 shows the disc that is rotationally slidably engaged in the receptacle with the pawl shown in conjunction with the cover ring, wherein the pawl shows the ratchet in the second operational state with the pawl asymmetrical gear teeth disengaged to the disc outer periphery and asymmetrical gear teeth thus allowing free rotation of the receptacle handle counterclockwise about the longitudinal axis and the disc free rotation clockwise about the longitudinal axis, wherein the pawl is moved away from the arcuate convergence against the means for biasing the pawl by the aforementioned relative asymmetrical gear teeth movement of the pawl and disc;

FIG. 32 is taken from cross section 32-32 from FIG. 16, wherein FIG. 32 shows the disc that is rotationally slidably engaged in the receptacle with the pawl shown in conjunction with the cover ring, wherein the disc outer periphery and asymmetrical gear teeth are slidably engaged with the slide surface and the radial internal diameter plus the internal diameter to have the disc retained within the receptacle while allowing free clockwise rotation about the longitudinal axis, also shown in FIG. 32 is the pawl asymmetrical gear teeth engaged to the disc outer periphery and asymmetrical gear teeth thus forming the first operational state of the ratchet; and FIG. 33 is taken from cross sections 33-33 from FIGS. 16 and 17, wherein FIG. 33 shows the disc that is rotationally slidably engaged in the receptacle with the pawl shown in conjunction with the cover ring and more particularly the means for biasing the pawl toward the arcuate convergence wherein the means is preferably a spring, wherein FIG. 33 shows the disc outer periphery and asymmetrical gear teeth are slidably engaged with the slide surface and the radial internal diameter plus the internal diameter to have the disc retained within the receptacle while allowing free clockwise rotation about the longitudinal axis, also shown in FIG. 33 is the pawl asymmetrical gear teeth engaged to the disc outer periphery and asymmetrical gear teeth thus forming the first operational state of the ratchet.

DETAILED DESCRIPTION OF THE INVENTION

Figure 1:
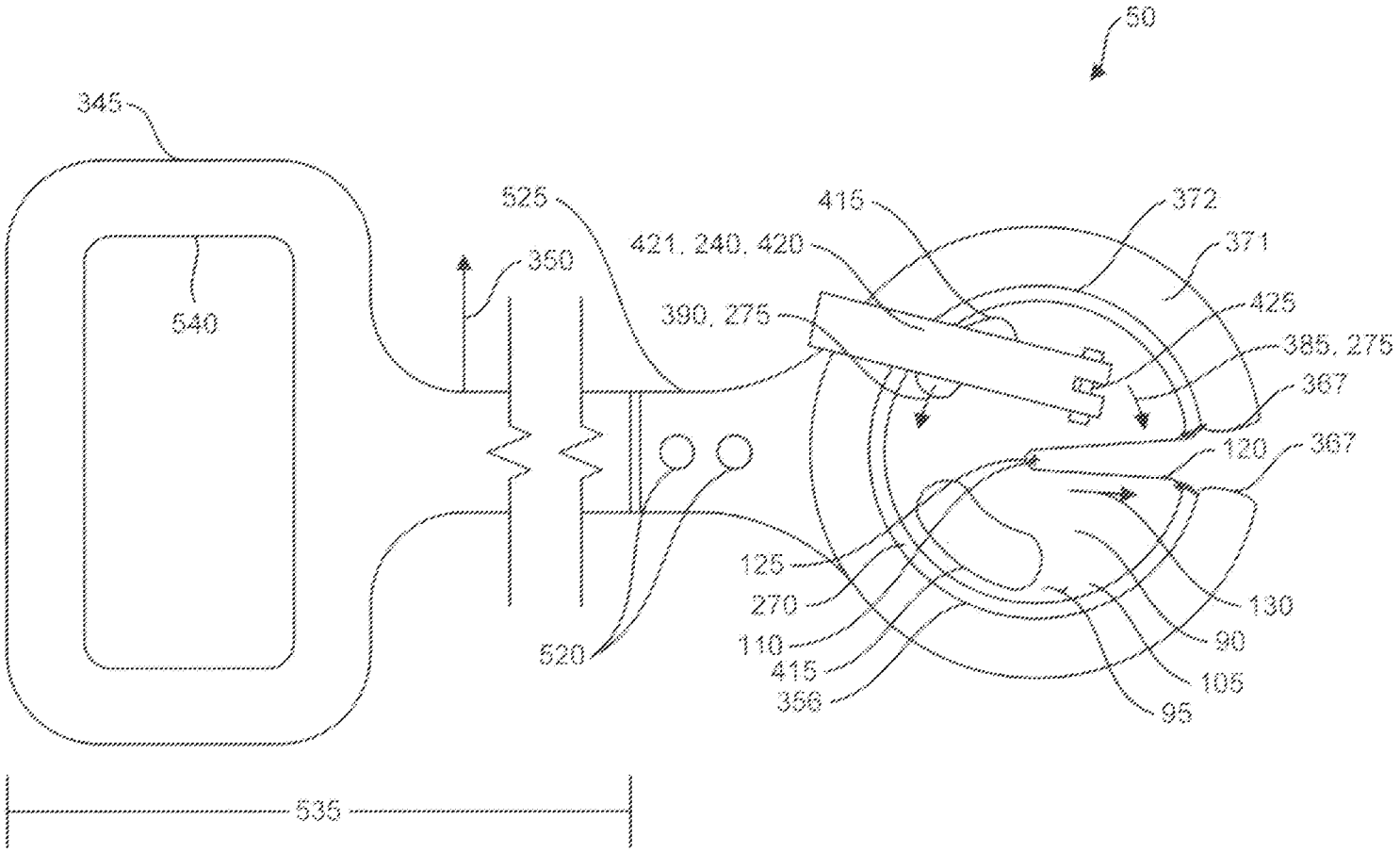
FIG. 1 shows a side elevation view of the article bender apparatus that includes the receptacle, the cover ring, the receptacle handle, the disc, wherein the disc slot and the receptacle slot are aligned, and the cam lock clamp with the quick release handle is shown on the disc in the locked or closed operational state with the quick release handle being adjacent to the disc first face portion.

With initial reference to FIG. 1 shows a side elevation view of the article bender apparatus 50 that includes the receptacle 356, the cover ring 371, the receptacle 356 handle 345, the disc 90, wherein the disc 90 slot 120 and the receptacle 356 slot 367 are aligned, and the cam lock clamp 420 with the quick release handle is shown on the disc 90 in the locked or closed operational state 421 with the quick release handle being adjacent to the disc 90 first face portion 95.

Figure 2:
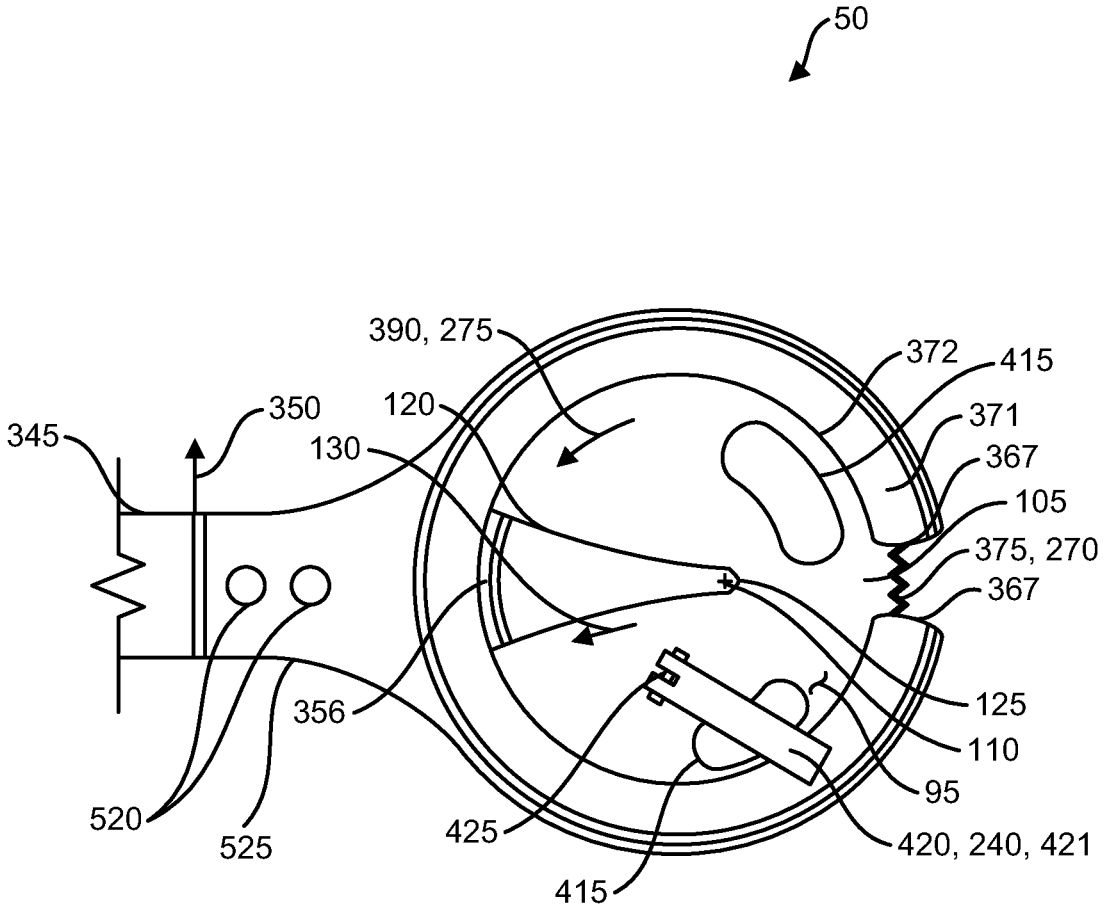
FIG. 2 shows a close-up side elevation view of the article bender apparatus that includes the receptacle, the cover ring, a portion of the receptacle handle, the disc, wherein the disc slot and the receptacle slot are not aligned, and the cam lock clamp with the quick release handle is shown on the disc in the locked or closed operational state with the quick release handle being adjacent to the disc first face portion.

Continuing, FIG. 2 shows a close-up side elevation view of the article bender apparatus 50 that includes the receptacle 356, the cover ring 371, a portion of the receptacle 356 handle 345, the disc 90, wherein the disc 90 slot 120 and the receptacle 356 slot 367 are not aligned, and the cam lock clamp 420 with the quick release handle is shown on the disc 90 in the locked or closed operational state 421 with the quick release handle being adjacent to the disc 90 first face portion 95.

Figure 3:
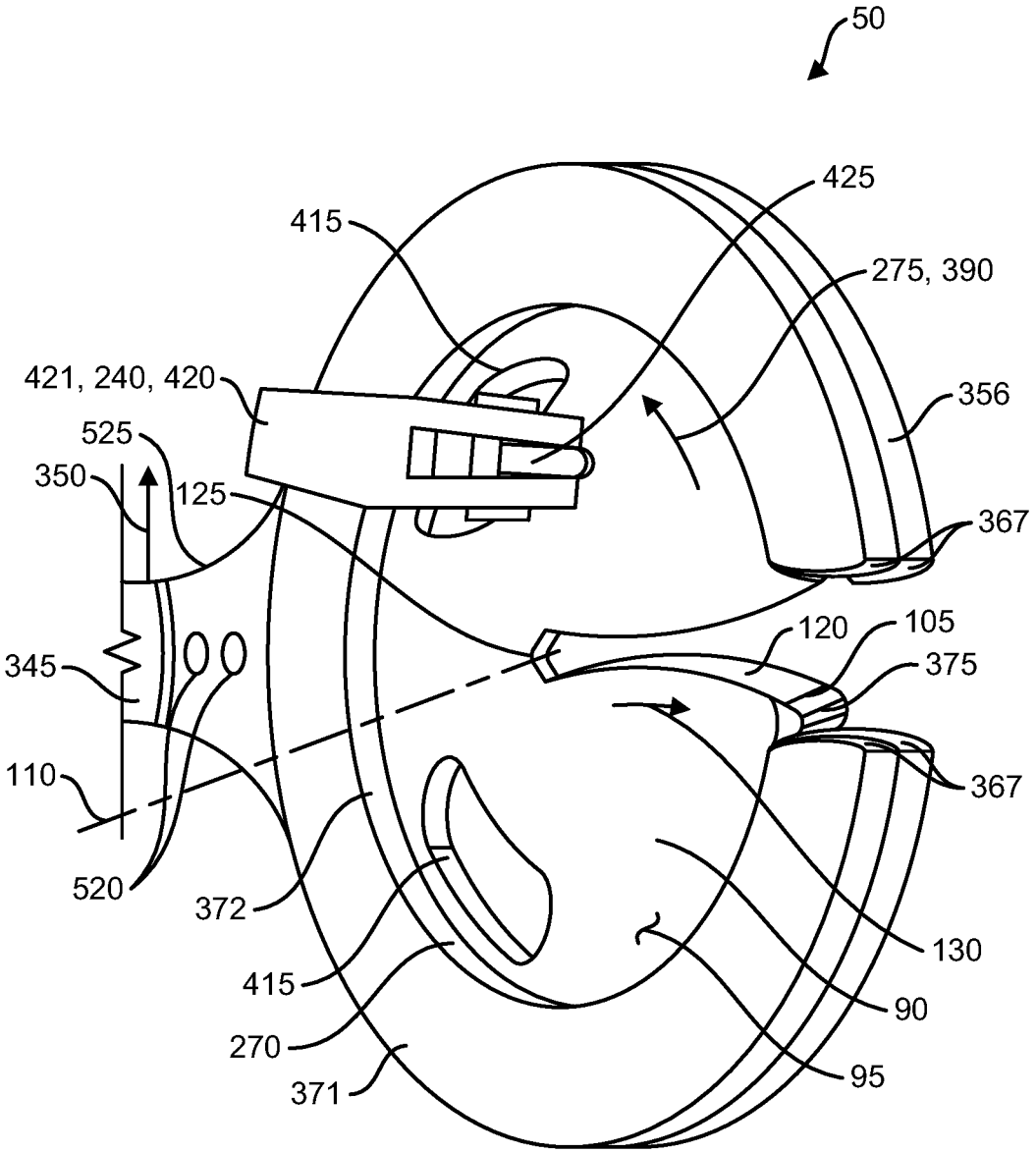
FIG. 3 shows an expanded front perspective view of the article bender apparatus that includes the receptacle, the cover ring, a portion of the receptacle handle, the disc, wherein the disc slot and the receptacle slot are aligned, and the cam lock clamp with the quick release handle is shown on the disc in the locked or closed operational state with the quick release handle being adjacent to the disc first face portion.

Next, FIG. 3 shows an expanded front perspective view of the article bender apparatus 50 that includes the receptacle 356, the cover ring 371, a portion of the receptacle 356 handle 345, the disc 90, wherein the disc 90 slot 120 and the receptacle 356 slot 367 are aligned, and the cam lock clamp 420 with the quick release handle is shown on the disc in the locked or closed operational state 421 with the quick release handle being adjacent to the disc 90 first face portion 95.

Figure 4:
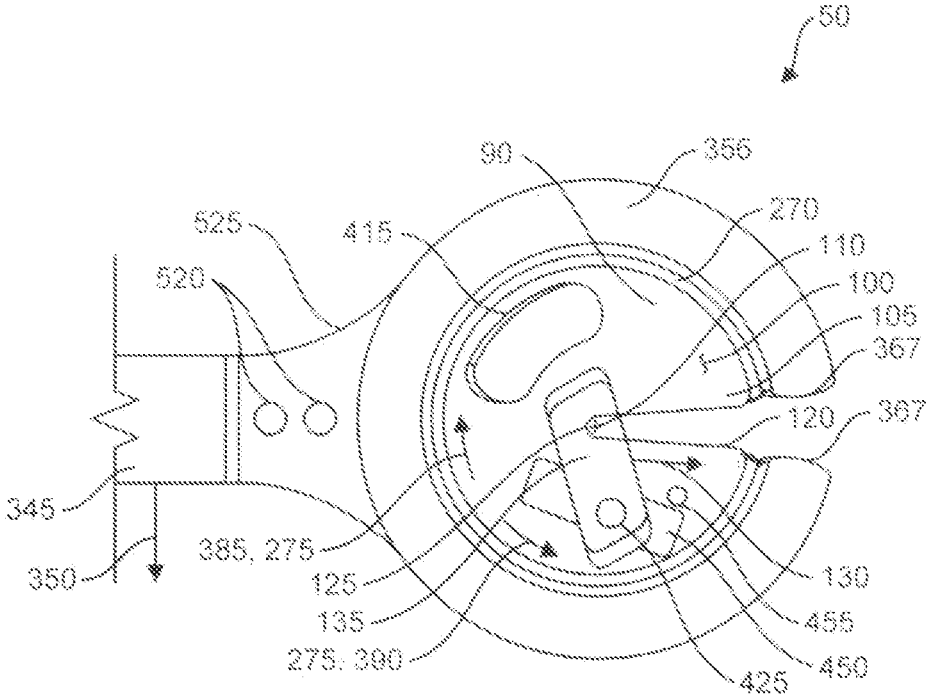
FIG. 4 shows a close-up side elevation view of the article bender apparatus that is an opposite or opposing side view of FIG. 2, wherein FIG. 4 includes the receptacle, noting that the cover ring is not shown in this view as it is on the opposite side and shown in FIG. 4 is the solid opposing side of the receptacle, further shown is a portion of the receptacle handle, the disc, wherein the disc slot and the receptacle slot are aligned, and the cam lock clamp with the quick release handle is not shown as being on the opposite side of the disc, as FIG. 4 also shows the shoe and the angularly displaced retainer bar both mounted on the axial pivot bolt, plus the stop pin for the retainer bar, note for pictorial clarity, the flat spring and pivot rod are not shown.

Further, FIG. 4 shows a close-up side elevation view of the article bender apparatus 50 that is an opposite or opposing side view of FIG. 2, wherein FIG. 4 includes the receptacle 356, noting that the cover ring 371 is not shown in this view as it is on the opposite side and shown in FIG. 4 is the solid opposing side of the receptacle 356, further shown is a portion of the receptacle 356 handle 345, the disc 90, wherein the disc 90 slot 120 and the receptacle 356 slot 367 are aligned, and the cam lock clamp 420 with the quick release handle is not shown as being on the opposite side of the disc 90, as FIG. 4 also shows the shoe 135 and the angularly displaced retainer bar 450 both mounted on the axial pivot bolt 425, plus the stop pin 455 for the retainer bar 450, note for pictorial clarity, the flat spring 430 and pivot rod 435 are not shown.

Figure 5:
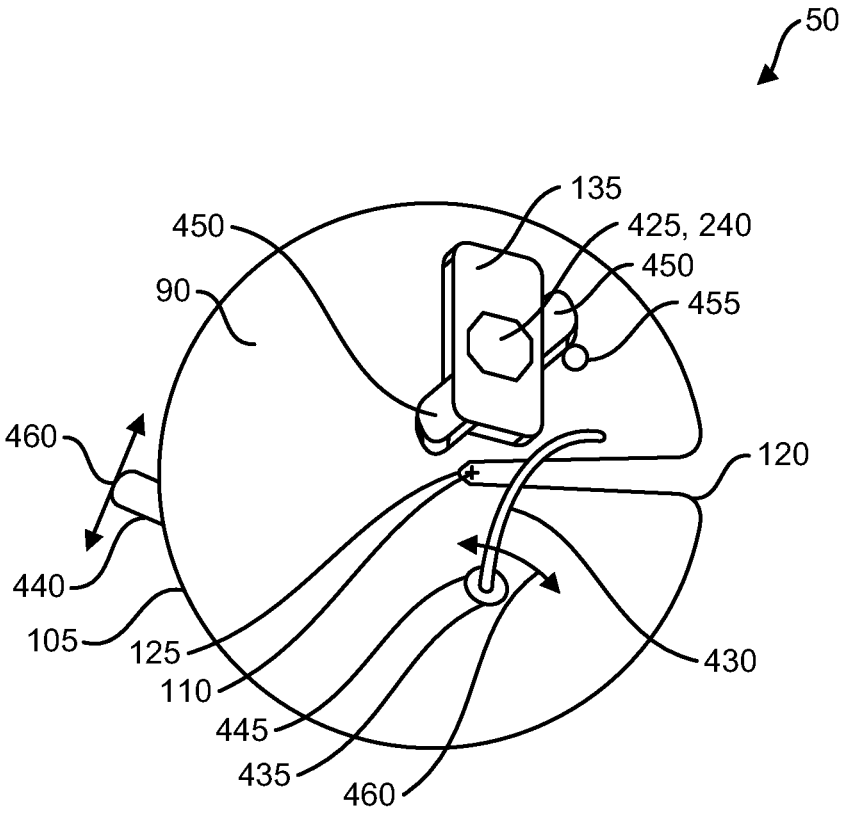
FIG. 5 shows a side elevation view of the disc with the slot and slot root section, wherein also shown is the shoe and the angularly displaced retainer bar that are both pivotally attached by the axial pivot bolt, further shown in FIG. 5 is the retainer bar stop pin, the flat spring with the pivot rod and the pivot rod aperture, in addition to the flat spring handle.

Moving onward, FIG. 5 shows a side elevation view of the disc 90 with the slot 120 and slot root section 125, wherein also shown is the shoe 135 and the angularly displaced retainer bar 450 that are both pivotally attached by the axial pivot bolt 425, further shown in FIG. 5 is the retainer bar 450 stop pin 455, the flat spring 430 with the pivot rod 435 and the pivot rod aperture 445, in addition to the flat spring handle 440.

Figure 6:
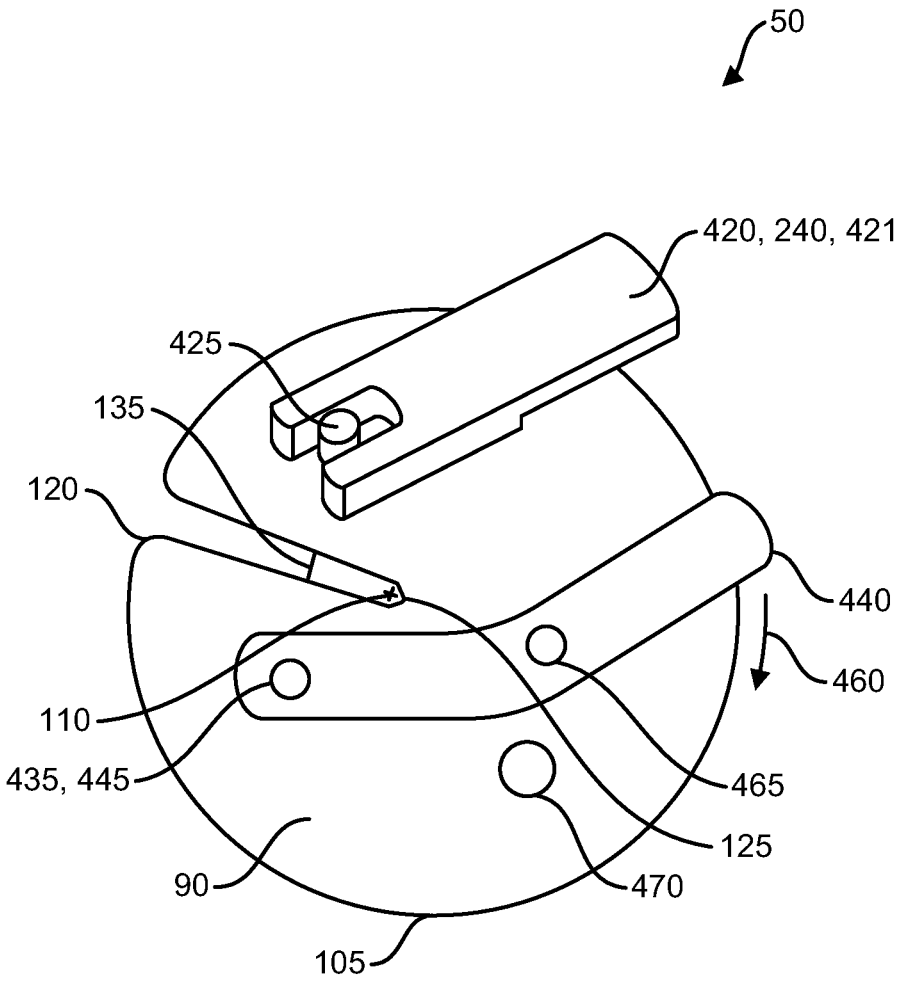

Further, FIG. 6 shows an opposing side elevation view of FIG. 5, wherein FIG. 6 shows the disc 90 with the slot 120 and slot root section 125, wherein also shown is the cam lock clamp 420 with the quick release handle being shown on the disc 90 in the locked or closed operational state 421 with the quick release handle being adjacent to the disc 90 first face portion 95, also shown is the flat spring 430 handle 440 with the pivot rod 435 and the pivot rod 435 aperture 445, plus the handle 440 ball protrusion 465 and the receiving depression 470 for the handle 440 ball protrusion 465 that through pivot rod 435 pivotal movement 460 secures the pivot rod 435 in a locked position for the flat spring 430 (not shown).

Figure 7:
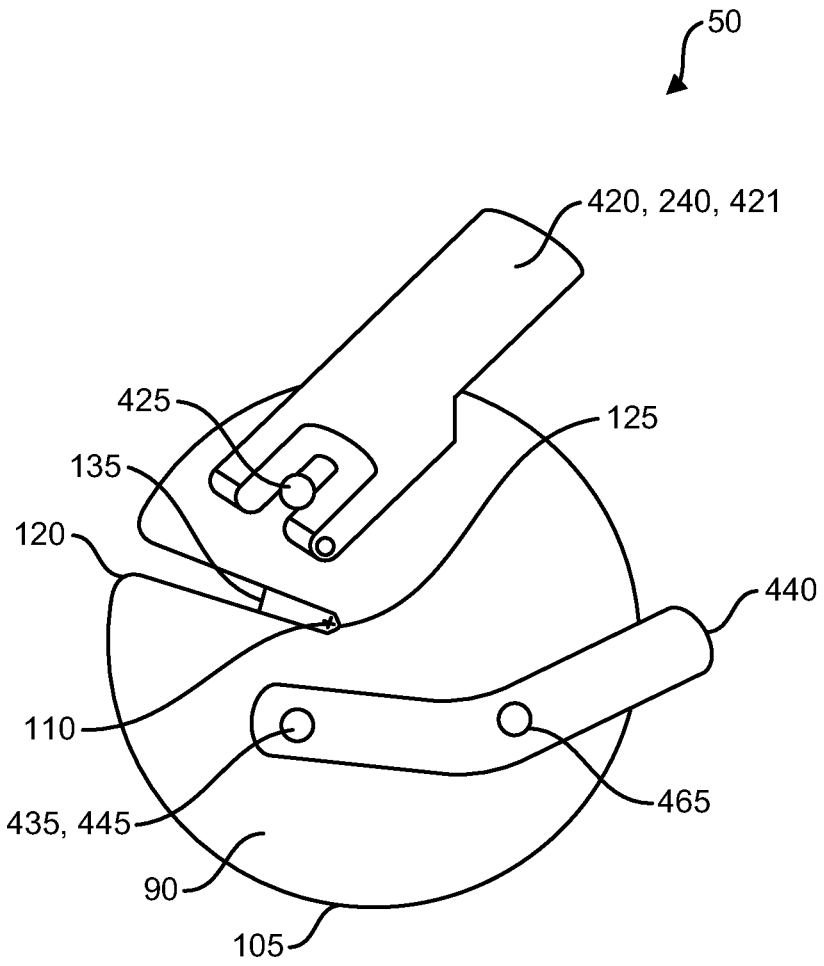

Next, FIG. 7 shows the side elevation view of FIG. 6, however, with the flat spring 430 handle 440 moved into the locked position, wherein FIG. 7 shows the disc 90 with the slot 120 and slot root section 125, wherein also shown is the cam lock clamp 420 with the quick release handle being shown on the disc 90 in the locked or closed operational state 421 with the quick release handle being adjacent to the disc 90 first face portion 95, also shown is the flat spring 430 handle 440 with the pivot rod 435 and the pivot rod 435 aperture 445, plus the handle 440 ball protrusion 465 and the receiving depression 470 connected for locking the flat spring 430 handle 440 that through pivot rod 435 pivotal movement 460 secures the pivot rod 435 in a locked position for the flat spring 430 (not shown).

Figure 8:
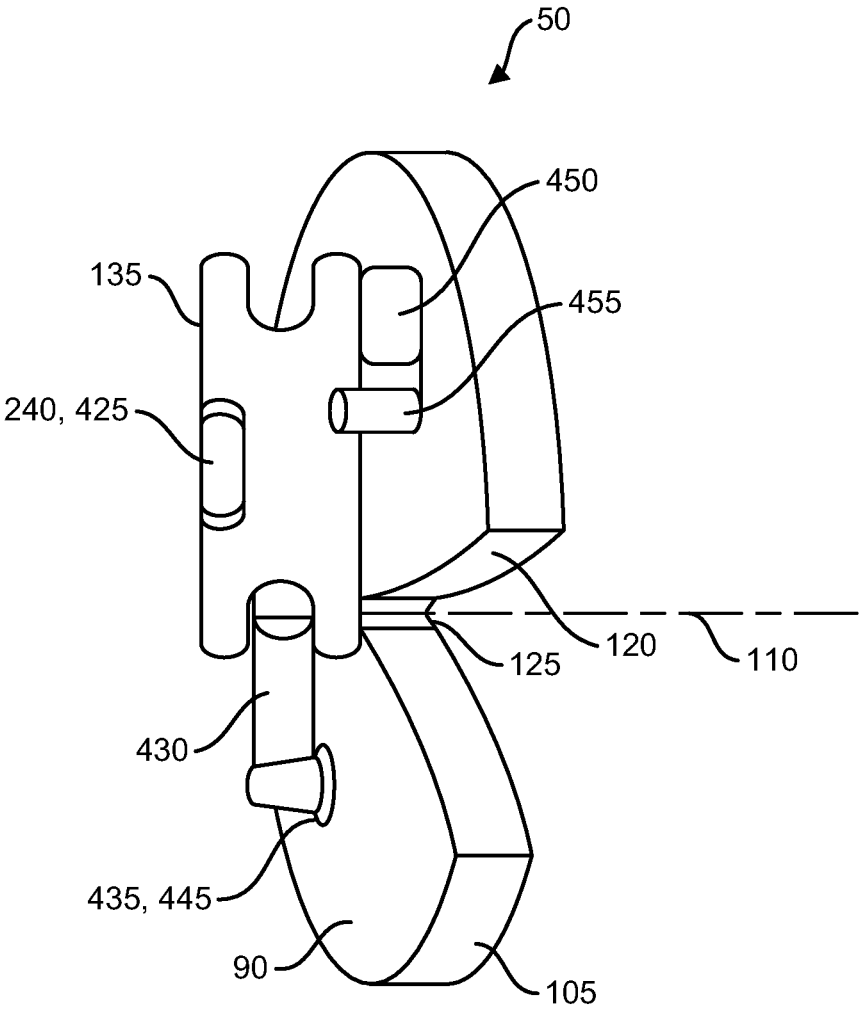

Moving on, FIG. 8 is a front perspective view of FIG. 5, wherein FIG. 8 shows the disc 90 with the slot 120 and slot root section 125, wherein also shown is the shoe 135 and the angularly displaced retainer bar 450 that are both pivotally attached by the axial pivot bolt 425, further shown in FIG. 8 is the retainer bar 450 stop pin 455, the flat spring 430 with the pivot rod 435 and the pivot rod aperture 445.

Figure 9:
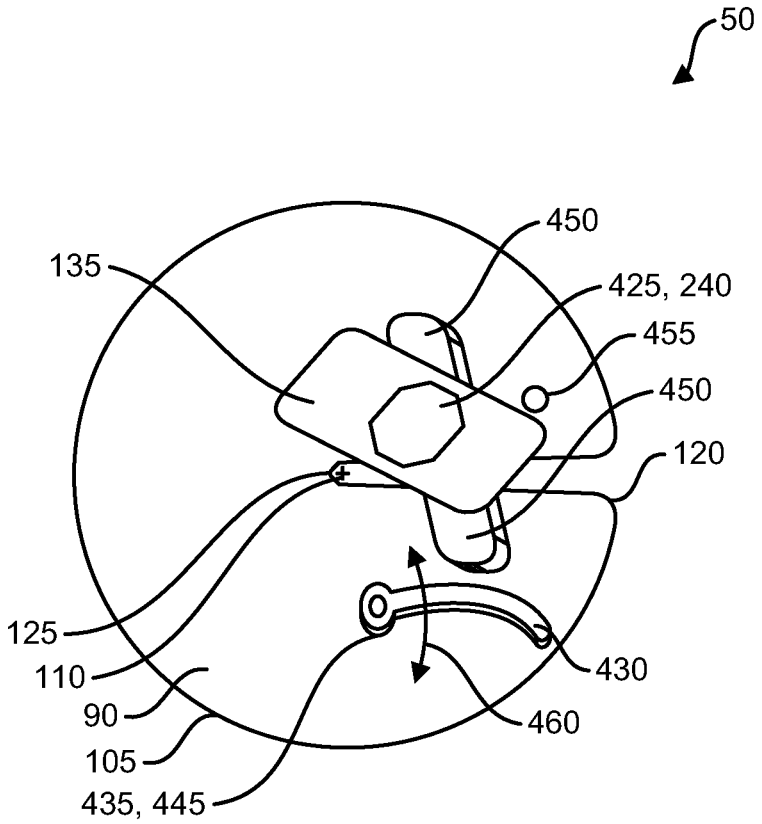

Next, FIG. 9 shows the side elevation view of FIG. 5, wherein FIG. 9 shows the flat spring 430 pivoted through pivotal movement 460 being moved downward away from the disc 90 slot 120 and disc slot root section 125, wherein also shown is the shoe 135 and the angularly displaced retainer bar 450 that are both pivotally attached by the axial pivot bolt 425, with the shoe 135 and retainer bar 450 pivotally moved past the slot 120 root section 125, further shown in FIG. 9 is the retainer bar 450 stop pin 455, and the flat spring 430 with the pivot rod 435 and the pivot rod aperture 445.

Figure 10:
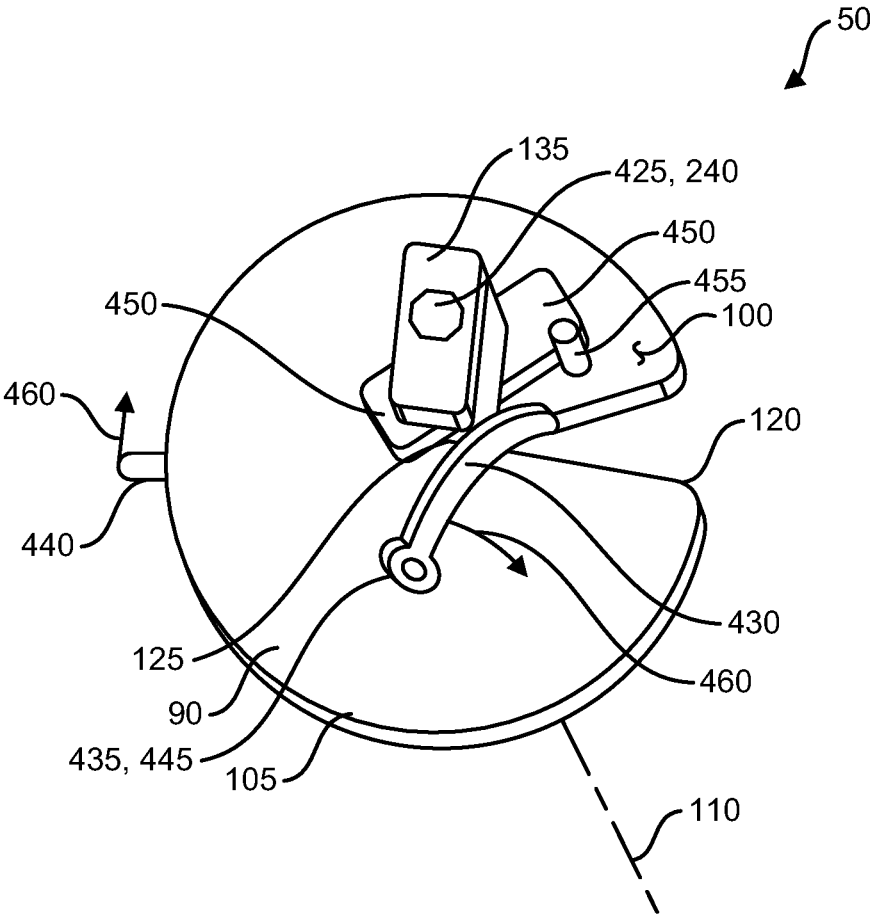

Continuing, FIG. 10 shows the side elevation view of FIG. 5, wherein FIG. 10 shows a lower perspective view of the disc 90 with the slot 120 and slot root section 125, wherein also shown is the shoe 135 and the angularly displaced retainer bar 450 that are both pivotally attached by the axial pivot bolt 425, further shown in FIG. 10 is the retainer bar 450 stop pin 455, the flat spring 430 with the pivot rod 435 and the pivot rod aperture 445, in addition to the flat spring handle 440.

Figure 11:
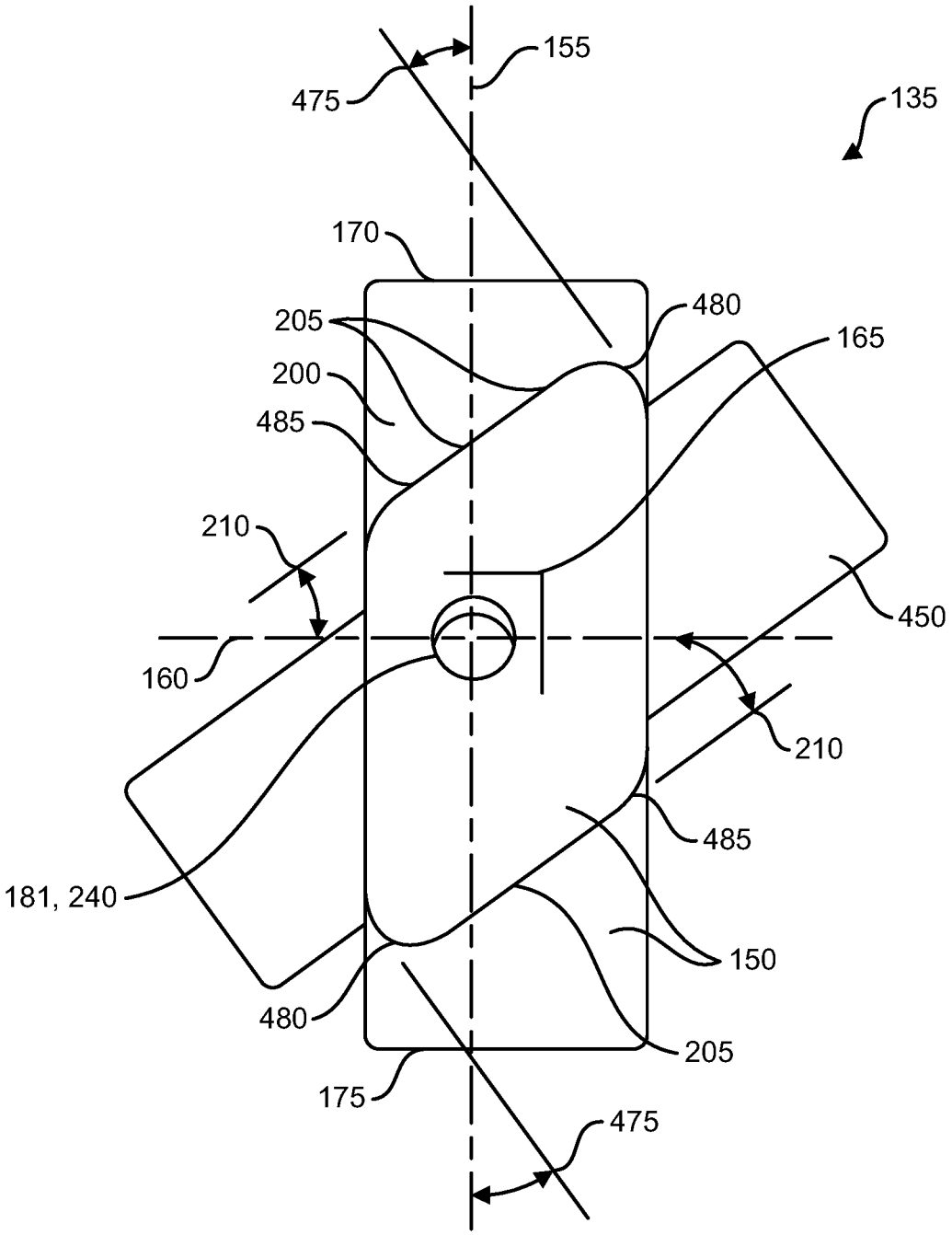
FIG. 11 shows a top view of the shoe and the angled retainer bar including the shoe first ridge and the shoe first channel, and the shoe aperture.
Figure 12:
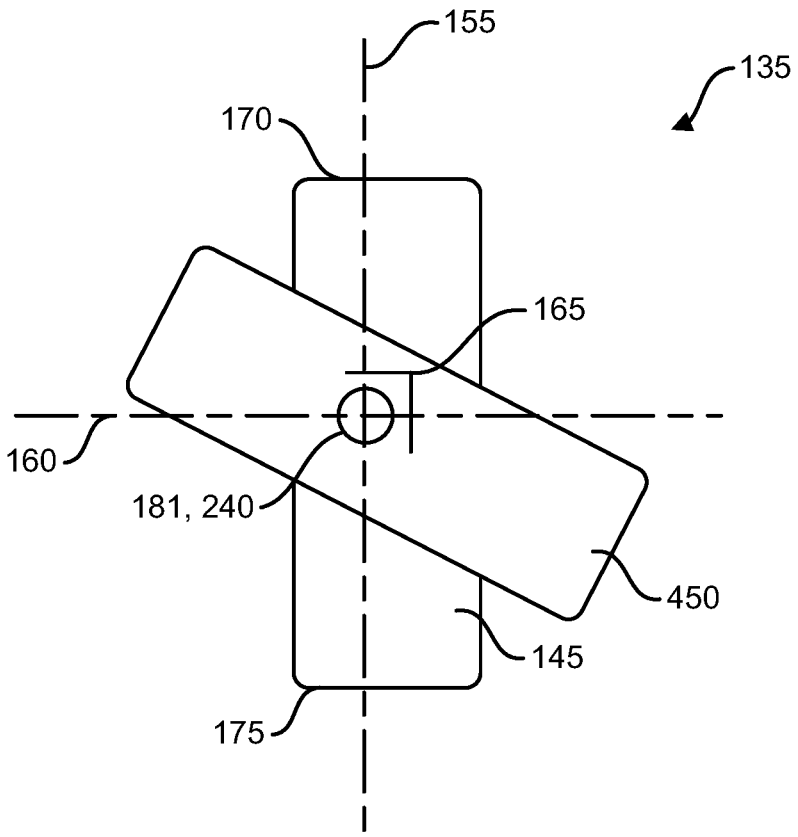
FIG. 12 shows a bottom view of the shoe and the angled retainer bar including the shoe aperture.
Figure 13:
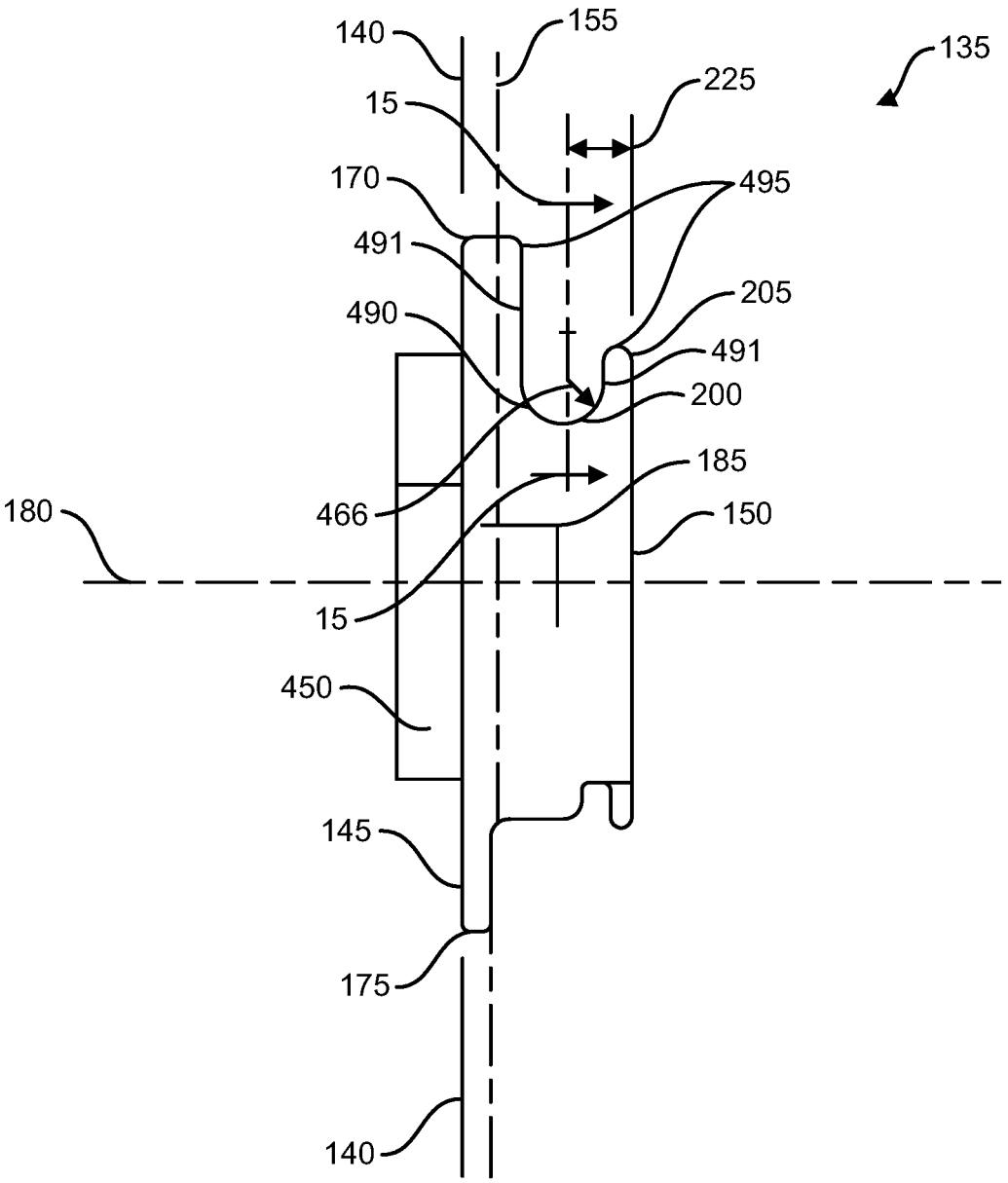
FIG. 13 shows an end view of the shoe and the retainer bar including the shoe first ridge and the shoe first channel with the axial axis.
Figure 14:
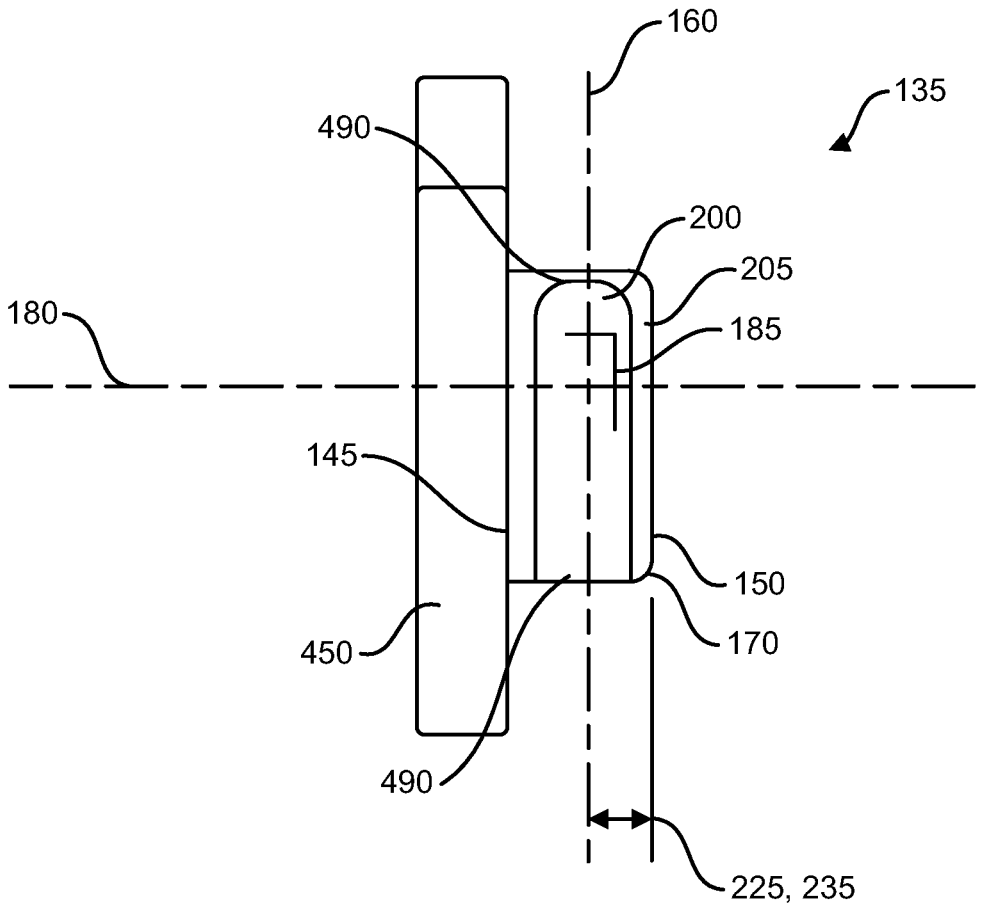
FIG. 14 shows a top elevation view of the shoe and the retainer bar including the first ridge and the first channel with the axial axis.
Figure 15:
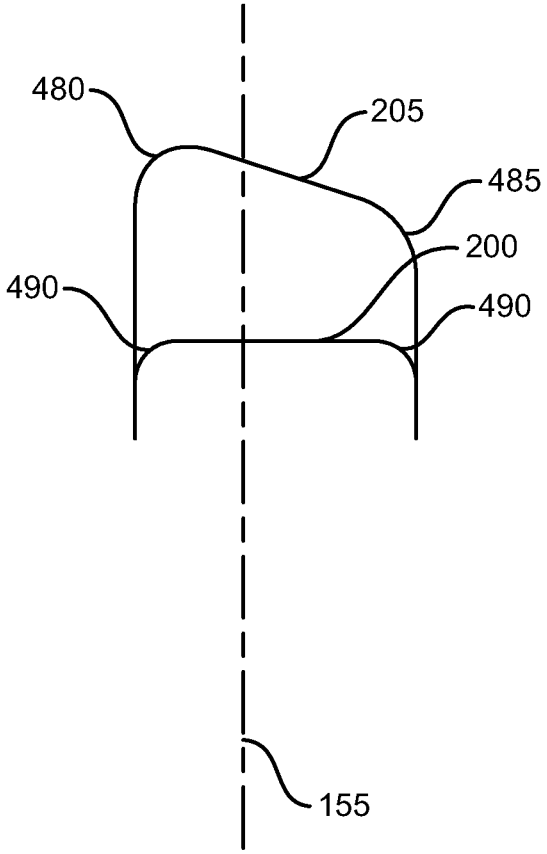

Further, FIG. 11 shows a top view of the shoe 135 and the angled retainer bar 450 including the shoe 135 first ridge 205 and the shoe first channel 200, and the shoe 135 aperture 181. Next, FIG. 12 shows a bottom view of the shoe 135 and the angled retainer bar 450 including the shoe 135 aperture 181. Further, FIG. 13 shows an end view of the shoe 135 and the retainer bar 450 including the shoe 135 first ridge 205 and the shoe 135 first channel 200 with the axial axis 180. Continuing, FIG. 14 shows a top elevation view of the shoe 135 and the retainer bar 450 including the first ridge 205 and the first channel 200 with the axial axis 180. Next, FIG. 15 is view 15-15 from FIG. 13, wherein FIG. 15 shows the first channel 200 and first ridge 205 with their associated chamfers being chamfers 480, 485 disposed on the first ridge 205 and chamfer 490 disposed on the first channel 200.

Figure 16:
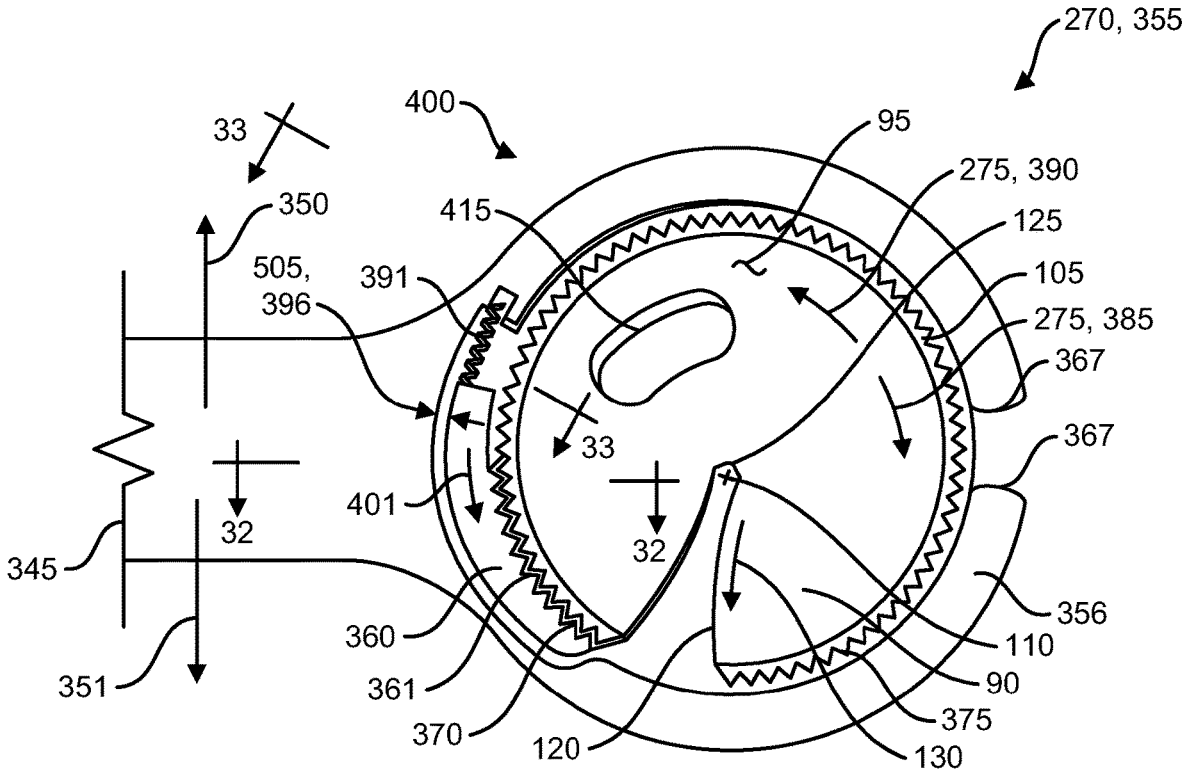
FIG. 16 shows a side elevation cutaway view of the receptacle with partial handle, with the receptacle having the cover ring removed to expose the disc with the outer periphery portion having the asymmetrical gear teeth wherein the disc outer periphery and asymmetrical gear teeth are slidably engaged with the slide surface and the radial internal diameter plus the internal diameter to have the disc retained within the receptacle while allowing free clockwise rotation about the longitudinal axis, also shown in FIG. 16 is the pawl asymmetrical gear teeth engaged to the disc outer periphery and asymmetrical gear teeth thus forming the first operational state of the ratchet, further shown is the means for means for biasing the pawl toward the arcuate convergence, wherein receptacle handle movement clockwise about the longitudinal axis will move the disc in rotational lockstep in a clockwise rotation about the longitudinal axis, further ratchet handle rotation counterclockwise about the longitudinal axis through the ratchet will allow the disc to either be static rotationally or freely rotate clockwise about the longitudinal axis.

Moving onward, FIG. 16 shows a side elevation cutaway view of the receptacle 356 with partial handle 345, with the receptacle 356 having the cover ring 371 removed to expose the disc 90 with the outer periphery portion 105 having the asymmetrical gear teeth 375 wherein the disc 90 outer periphery 105 and asymmetrical gear teeth 375 are slidably engaged with the slide surface 357 and the radial internal diameter 358 plus the internal diameter 366 to have the disc 90 retained within the receptacle 356 while allowing free clockwise rotation 385 about the longitudinal axis 110, also shown in FIG. 16 is the pawl 360 asymmetrical gear teeth 361 engaged to the disc 90 outer periphery 105 and asymmetrical gear teeth 375 thus forming the first operational state 400 of the ratchet 355. Further shown in FIG. 16 is the means for means 391 for biasing the pawl 360 toward the arcuate convergence 389, wherein receptacle 356 handle 345 movement clockwise 350 about the longitudinal axis 110 will move the disc 90 in rotational lockstep in a clockwise rotation 350, 385 about the longitudinal axis 110, further ratchet 355 handle 345 rotation counterclockwise 351 about the longitudinal axis 110 through the ratchet 355 will allow the disc 90 to either be static rotationally or freely rotate clockwise 385 about the longitudinal axis 110.

Figure 17:
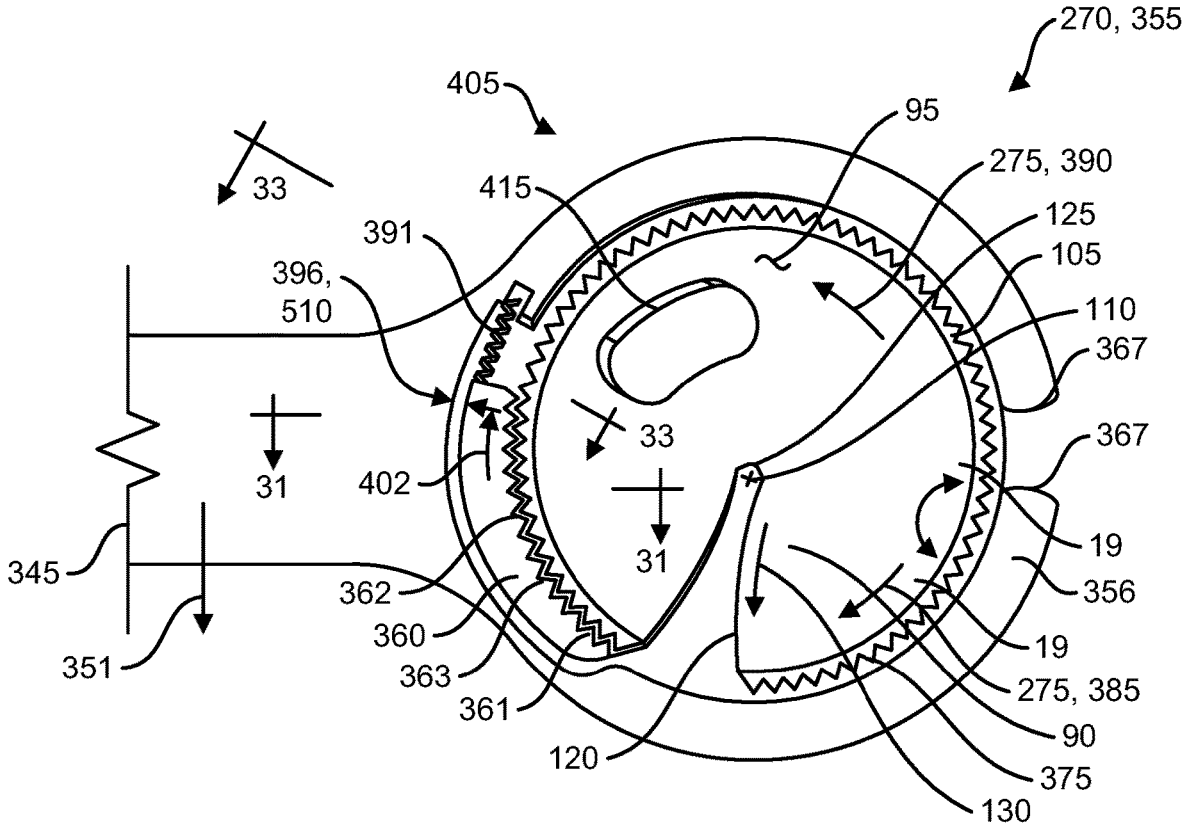

Further, FIG. 17 shows the side elevation view of FIG. 16, except wherein FIG. 17 shows the ratchet 355 in the second operational state 405 with the pawl 360 asymmetrical gear teeth 361 disengaged to the disc 90 outer periphery 105 and asymmetrical gear teeth 375 thus allowing free rotation 351 of the receptacle 356 handle 345 counterclockwise 351 about the longitudinal axis 110 and the disc 90 free rotation clockwise 385 about the longitudinal axis 110, wherein the pawl 360 is moved away from the arcuate convergence 389 against the means 391 for biasing the pawl 360 by the aforementioned relative asymmetrical gear teeth 361, 375 movement of the pawl 360 and disc 90. Further FIG. 17 shows the side elevation cutaway view of the receptacle 356 with partial handle 345, with the receptacle 356 having the cover ring 371 removed to expose the disc 90 with the outer periphery portion 105 having the asymmetrical gear teeth 375, wherein the disc 90 outer periphery 105 and asymmetrical gear teeth 375 are slidably disengaged 405, with the slide surface 357 and the radial internal diameter 358 plus the internal diameter 366 to have the disc 90 retained within the receptacle 356.

Figure 18:
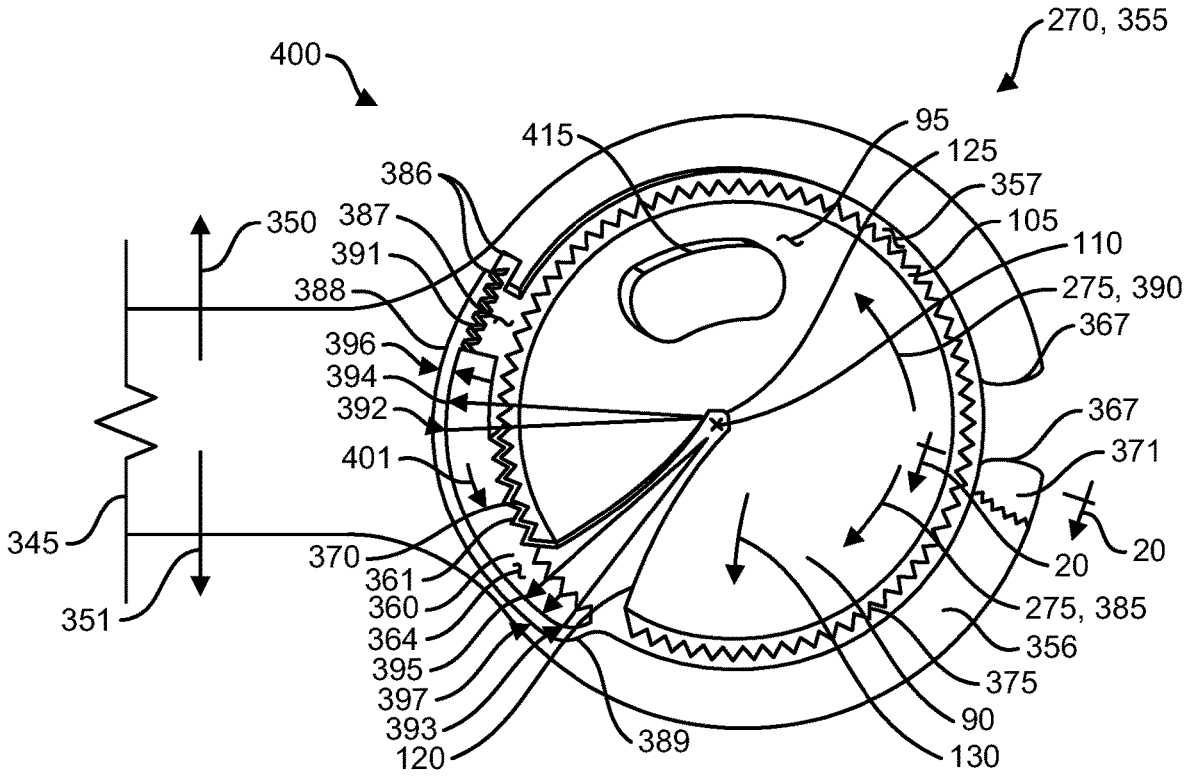
FIG. 18 shows the side elevation view of FIG. 16, wherein in FIG. 18 the disc slot is rotated about the longitudinal axis to show the disc slot (with no gear teeth) suspended over the pawl asymmetrical gear teeth, further the side elevation cutaway view of the receptacle with partial handle, with the receptacle having the cover ring removed to expose the disc with the outer periphery portion having the asymmetrical gear teeth wherein the disc outer periphery and asymmetrical gear teeth are slidably engaged with the slide surface and the radial internal diameter plus the internal diameter to have the disc retained within the receptacle while allowing free clockwise rotation about the longitudinal axis, also shown in FIG. 18 is the pawl asymmetrical gear teeth engaged to the disc outer periphery and asymmetrical gear teeth thus forming the first operational state of the ratchet, further shown is the means for means for biasing the pawl toward the arcuate convergence, additionally the constant operational gap is shown along with the converging operational gap as between the pawl primary and secondary margins and the recessed cavity of the receptacle first and second boundary arc margins, wherein receptacle handle movement clockwise about the longitudinal axis will move the disc in rotational lockstep in the clockwise rotation about the longitudinal axis, further receptacle handle rotation counterclockwise about the longitudinal axis through the ratchet will allow the disc to either be static rotationally or freely rotate clockwise about the longitudinal axis.

Continuing, FIG. 18 shows the side elevation view of FIG. 16, wherein FIG. 18 the disc 90 slot 120 is rotated 385 about the longitudinal axis 110 to show the disc 90 slot 120 (with no gear teeth) suspended over the pawl 360 asymmetrical gear teeth 361, further the side elevation cutaway view of the receptacle 356 with partial handle 345, with the receptacle 356 having the cover ring 371 removed to expose the disc 90 with the outer periphery portion 105 having the asymmetrical gear teeth 375 wherein the disc 90 outer periphery 105 and asymmetrical gear teeth 375 are slidably engaged with the slide surface 357 and the radial internal diameter 358 plus the internal diameter 366 to have the disc 90 retained within the receptacle 356 while allowing free clockwise rotation 385 about the longitudinal axis 110. Also shown in FIG. 18 is the pawl 360 asymmetrical gear teeth 361 engaged to the disc 90 outer periphery 105 and asymmetrical gear teeth 375 thus forming the first operational state 400 of the ratchet 355, further shown is the means for means 391 for biasing the pawl 360 toward the arcuate convergence 389.

Additionally, FIG. 18 shows the constant operational gap 396 is shown along with the converging operational gap 397 as between the pawl 360 primary 403 and secondary 404 margins and the recessed cavity 386 of the receptacle 356 first 388 and second 389 boundary arc margins, wherein receptacle 356 handle movement 345 clockwise 350 about the longitudinal axis 110 will move the disc 90 in rotational lockstep in the clockwise rotation 385 about the longitudinal axis 110, further receptacle 356 handle 345 rotation counterclockwise 351 about the longitudinal axis 110 through the ratchet 355 will allow the disc 90 to either be static rotationally or freely rotate clockwise 385 about the longitudinal axis 110.

Figure 19:
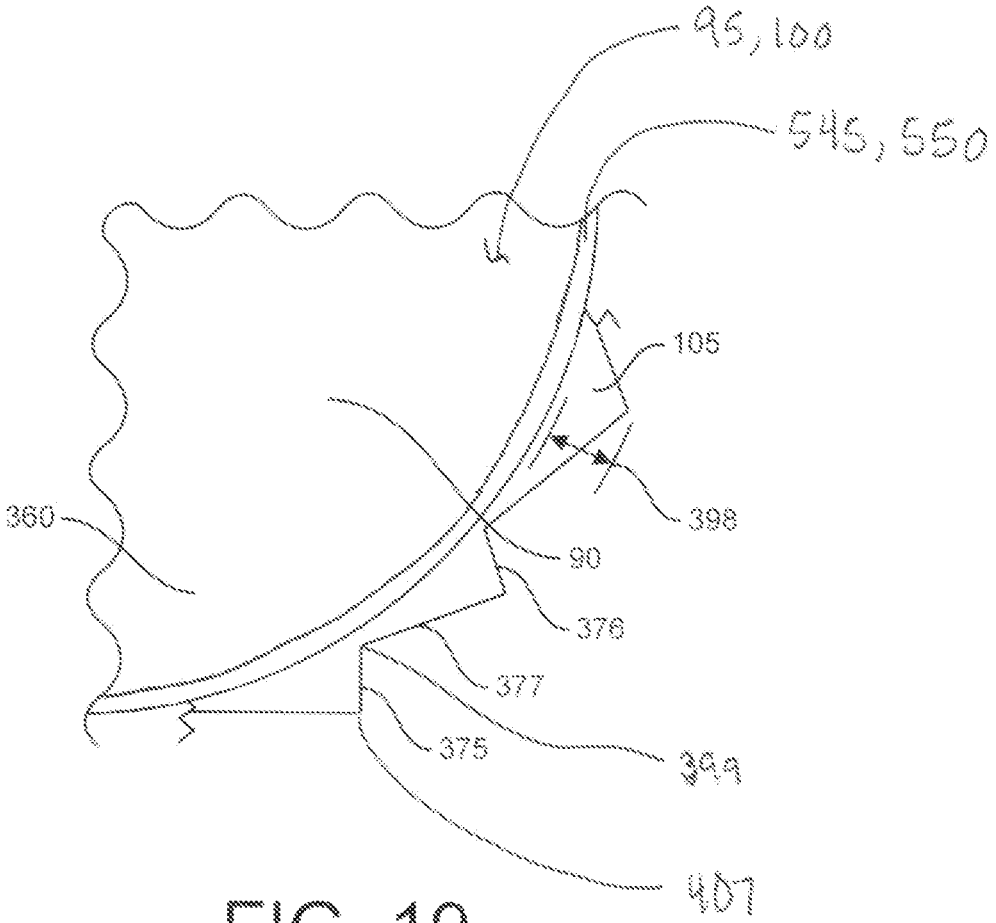
FIG. 19 shows a close-up of the asymmetrical gear teeth of either the disc outer periphery portion or the pawl to define the tooth height distance.
Figure 20:
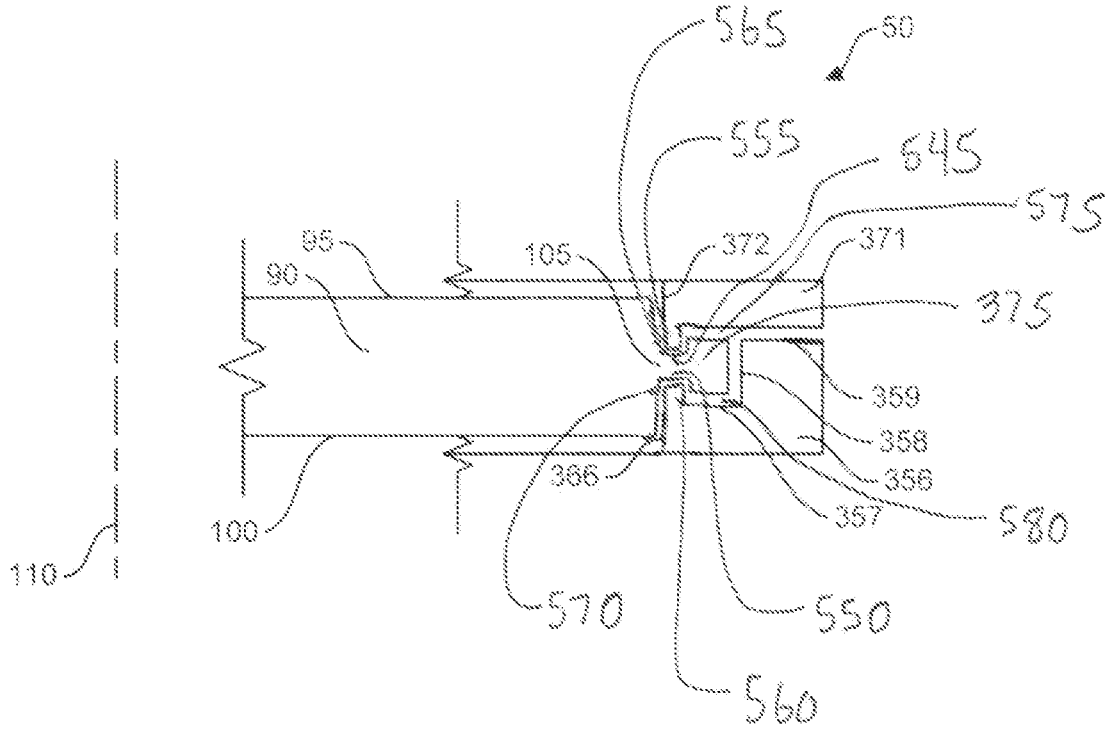
Figure 21:
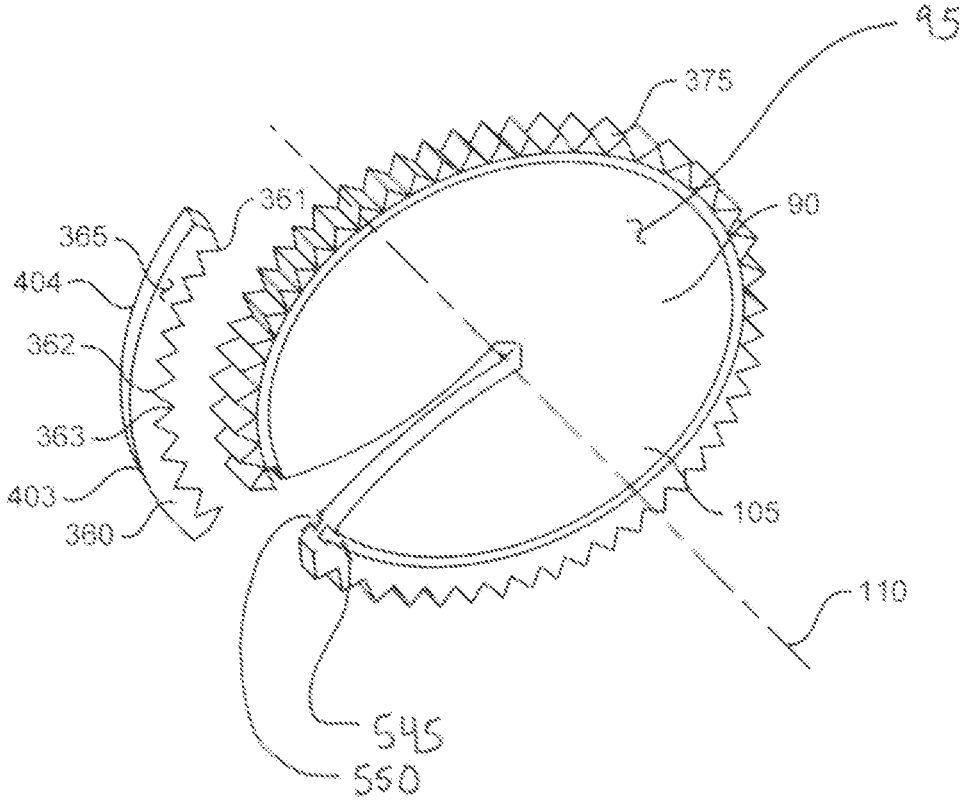
FIG. 21 shows a bottom perspective view of the core of the ratchet with the disc shown with the outer periphery and symmetrical gear teeth disposed on the disc outer periphery and the pawl with the asymmetrical gear teeth, further with the pawl second side, the pawl primary boundary margin, and the pawl secondary boundary margin.

Further, FIG. 19 shows a close-up of the asymmetrical gear teeth 361, 375 of either the disc 90 outer periphery portion 105 or the pawl 360 to define the tooth height 398 distance. Next, FIG. 20 is view 20-20 from FIG. 18, wherein FIG. 20 shows detail of the receptacle 356, cover ring 371, and disc 90 outer periphery 105 asymmetric gear teeth 375 slidable interface 357 along with the internal diameter 366 of the receptacle 356, slide surface 357 of the receptacle 356, the top surface 359 of the receptacle 356, and internal diameter 366 of the cover ring 371. Further, FIG. 21 shows a bottom perspective view of the core of the ratchet 355 with the disc 90 shown with the outer periphery 105 and symmetrical gear teeth 375 disposed on the disc 90 outer periphery 105 and the pawl 360 with the asymmetrical gear teeth 361, further with the pawl 360 second side 365, the pawl 360 primary boundary margin 403, and the pawl 360 secondary boundary margin 404.

Figure 22:
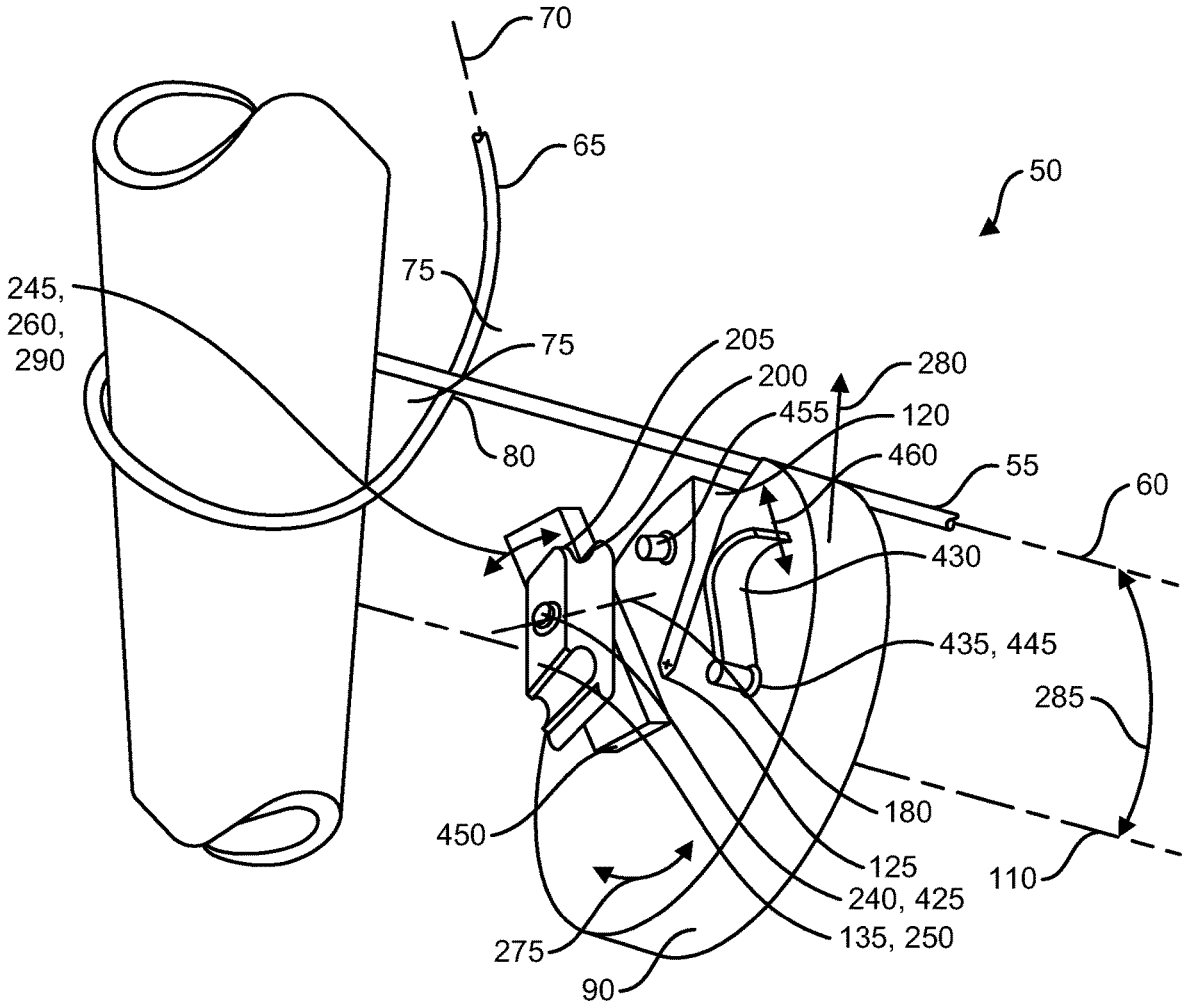
FIG. 22 shows an upper perspective view of the article bender apparatus in use with the initial use step shown of the disc slot being positioned adjacent to a first line with the shoe and the retainer bar in the open state along with the flat spring pivoted away from the disc slot, noting that the second line is positioned substantially perpendicular to the first line, note that for pictorial clarity the ratchet, receptacle, and receptacle handle are not shown.

Next, FIG. 22 shows an upper perspective view of the article bender apparatus 50 in use with the initial use step shown of the disc 90 slot 120 being positioned adjacent to the first line 55 with the shoe 135 and the retainer bar 450 in the open state 250, 422 along with the flat spring 430 pivoted away 460 from the disc 90 slot 120, noting that the second line 65 is positioned substantially perpendicular 75 to the first line 55, note that for pictorial clarity the ratchet 355, receptacle 356, and receptacle 356 handle 345 are not shown.

Figure 23:
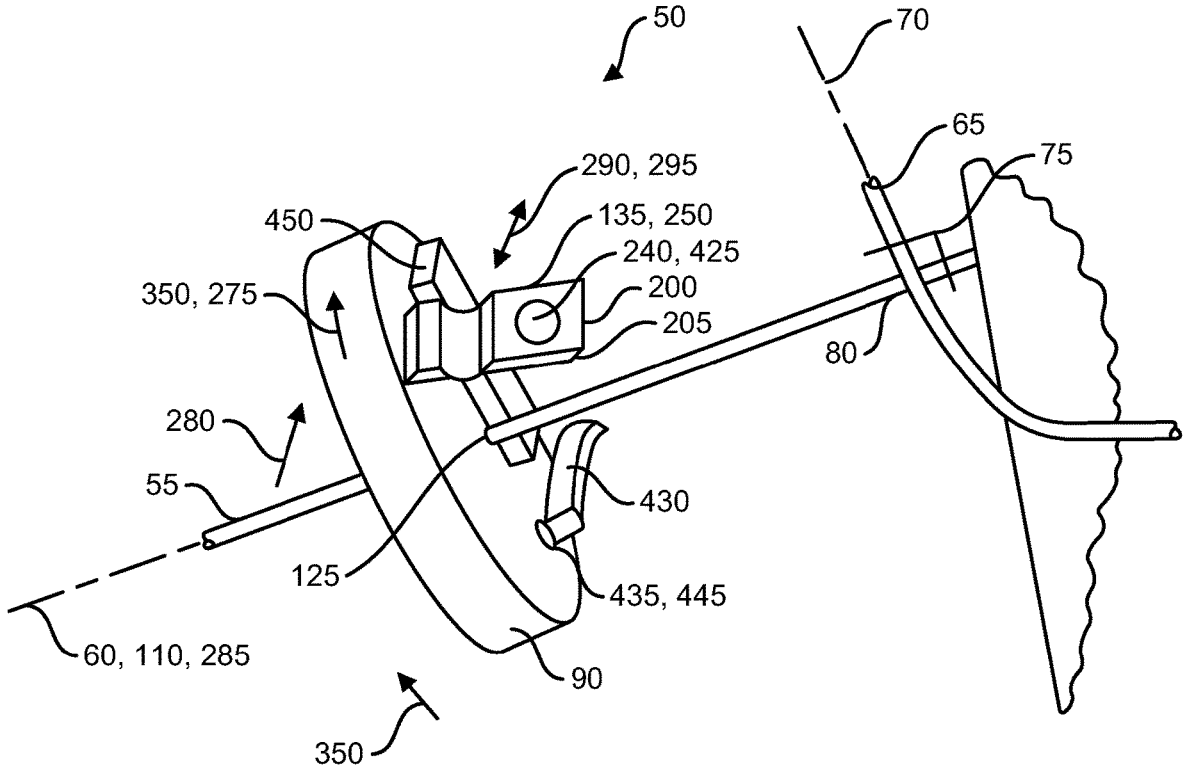
FIG. 23 shows an upper perspective view of the article bender apparatus in use with the second use step shown of the disc slot root section being positioned adjacent to the first line with the shoe and the retainer bar in the closed operational state with the retainer bar contacting the first line in the disc slot root section along with the flat spring pivoted away from the disc slot, noting that the second line is positioned substantially perpendicular to the first line and that the shoe can now be placed into the closed operational state, note that for pictorial clarity the ratchet, receptacle, and receptacle handle are not shown.

Further, FIG. 23 shows an upper perspective view of the article bender apparatus 50 in use with the second use step shown of the disc 90 slot 120 root section 125 being positioned adjacent to the first line 55 with the shoe 135 and the retainer bar 450 in the closed operational state 255, 421 with the retainer bar 450 contacting the first line 55 in the disc 90 slot 120 root section 125 along with the flat spring 430 pivoted away from the disc 90 slot 120, noting that the second line 65 is positioned substantially perpendicular 75 to the first line 55 and that the shoe 135 can now be placed into the closed operational state 255, 421, note that for pictorial clarity the ratchet 355, receptacle 356, and receptacle 356 handle 345 are not shown.

Figure 24:
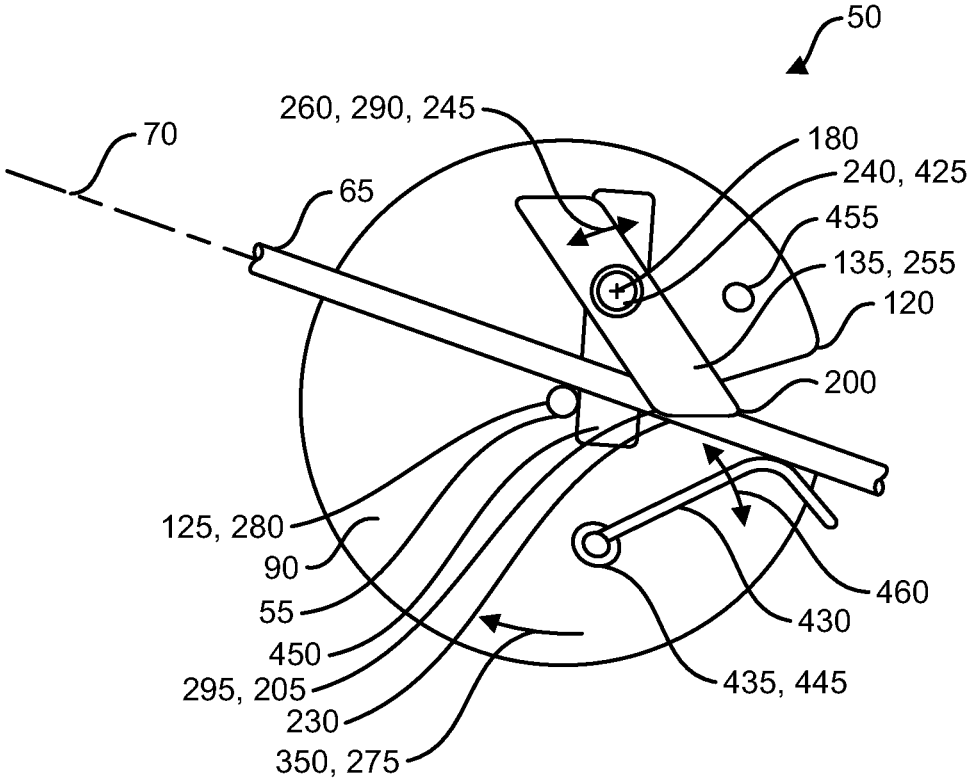

Continuing, FIG. 24 shows a disc 90 side elevation view and the shoe 135 and retainer bar 450 end view of FIG. 23, wherein FIG. 24 shows the first line 55 in the root section 125 of the slot 120 of the disc 90 contacting the retainer bar 450 with the shoe 135 and the retainer bar 450 in the closed operational state 255, 421 that positions the first channel 200 in relation to the second line free end portion 65 as the shoe 135 first channel 200 partially is encompassing the second line 65 and being held in place by the flat spring 430 applying pressure onto the second line 65 into the first channel 200 of the shoe 135, wherein with the manual rotation 350, 385 of the disc 90 the shoe 135 first channel 200 will wrap 85 the second line 65 helically about the first line 55, note that for pictorial clarity the ratchet 355, receptacle 356, and receptacle 356 handle 345 are not shown.

Figure 25:
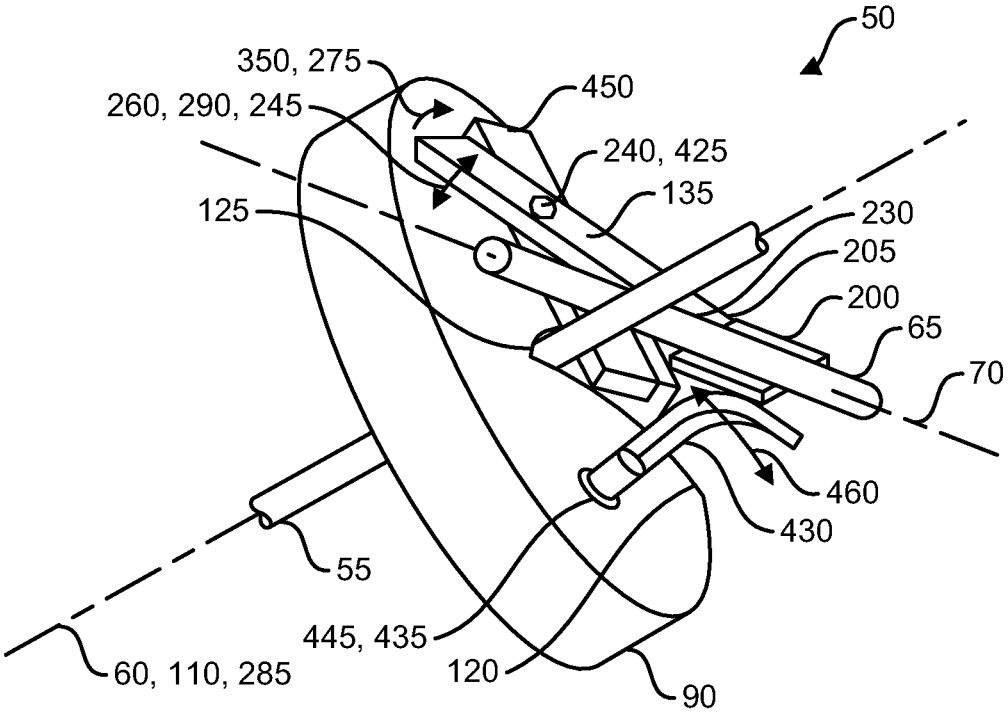

Moving onward, FIG. 25 shows a lower perspective view of FIG. 24, wherein FIG. 25 shows the disc 90 bottom view and the shoe 135 and retainer bar 450 bottom view of FIG. 24, wherein FIG. 25 shows the first line 55 in the root section 125 of the slot 120 of the disc 90 contacted by the retainer bar 450 with the shoe 135 and the retainer bar 450 in the closed operational state 255, 421. Further shown in FIG. 25 is the shoe 135 first channel 200 partially encompassing the second line 65 and being held in place by the flat spring 430 applying pressure onto the second line 65 into the first channel 200 of the shoe 135, wherein with the manual rotation 385 of the disc 90 the shoe 135 first channel 200 will wrap 85 the second line 65 helically 85 about the first line 55, note that for pictorial clarity the ratchet 355, receptacle 356, and receptacle 356 handle 345 are not shown.

Figure 26:
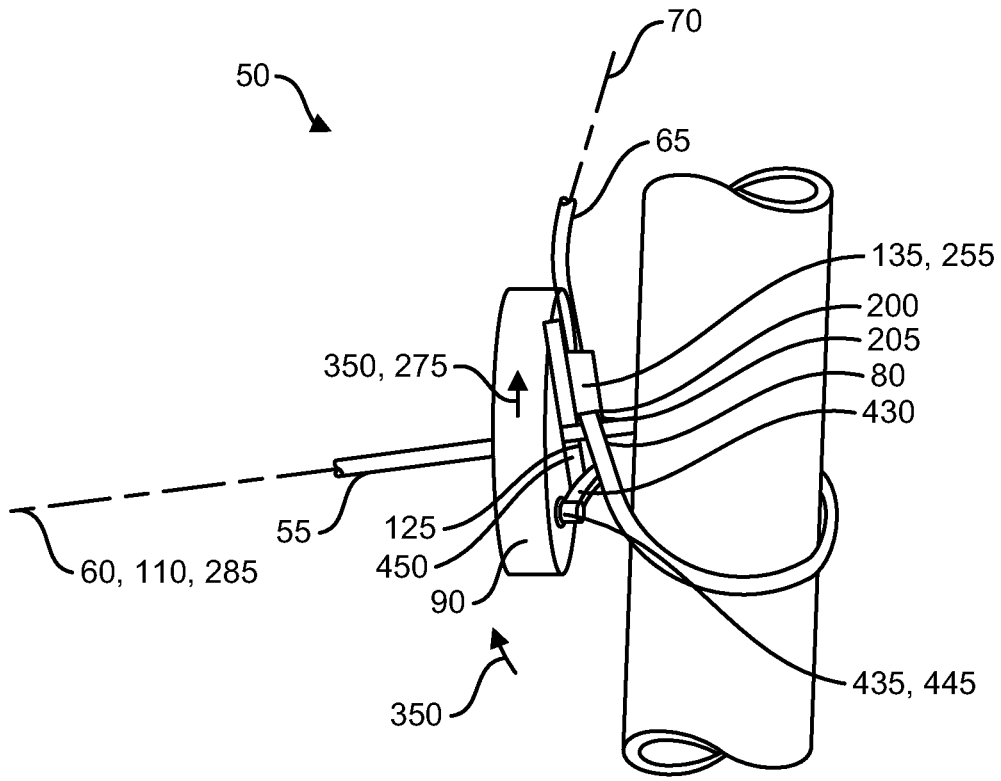
FIG. 26 shows an upper perspective view of the article bender apparatus in a third use step of starting to engage in rotational movement of the disc thus starting the selected helical wrap of the second line about the first line, note that for pictorial clarity the ratchet, receptacle, and receptacle handle are not shown.

Next, FIG. 26 shows an upper perspective view of the article bender apparatus 50 in a third use step of starting to engage in rotational movement 385 of the disc 90 thus starting the selected helical wrap 85 of the second line 65 about the first line 55, note that for pictorial clarity the ratchet 355, receptacle 356, and receptacle 356 handle 345 are not shown.

Figure 27:
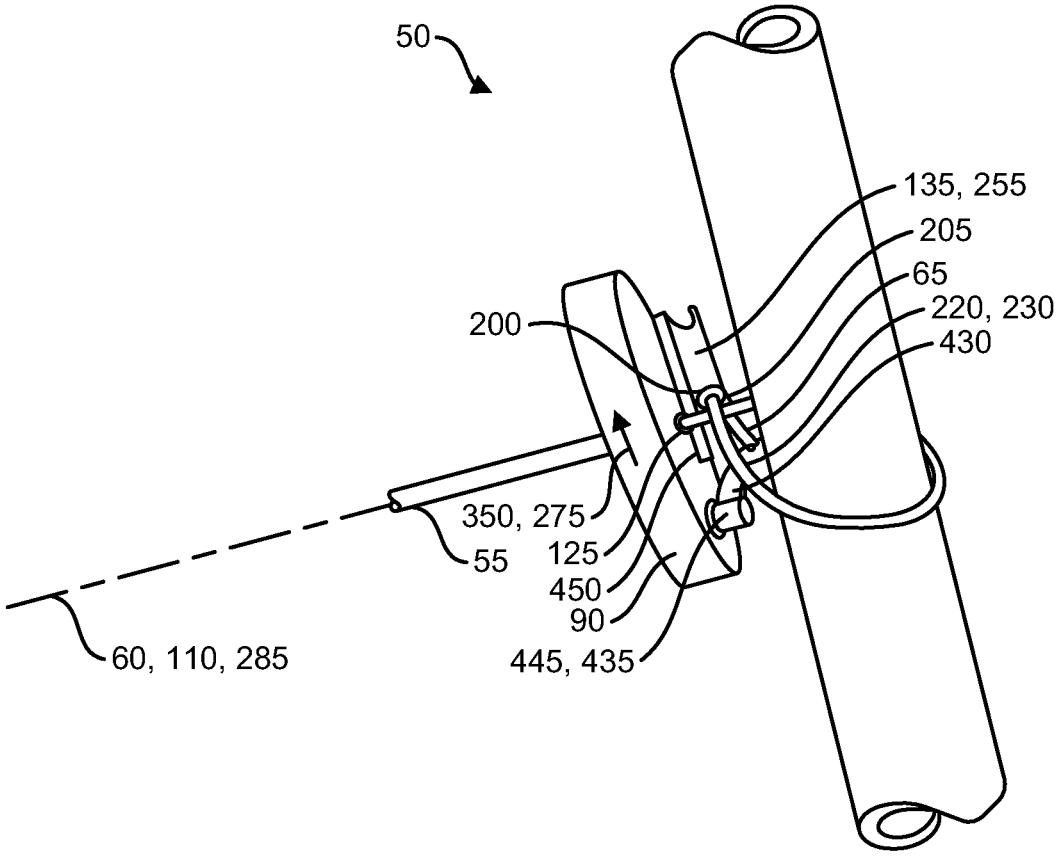
FIG. 27 shows an upper perspective view of the article bender apparatus in a fourth use step of continuing to engage in rotational movement of the disc thus continuing the selected helical wrap of the second line about the first line, note that for pictorial clarity the ratchet, receptacle, and receptacle handle are not shown.

Further, FIG. 27 shows an upper perspective view of the article bender apparatus 50 in a fourth use step of continuing to engage in rotational movement 385 of the disc 90 thus continuing the selected helical wrap 85 of the second line 65 about the first line 55, note that for pictorial clarity the ratchet 355, receptacle 356, and receptacle 356 handle 345 are not shown.

Figure 28:
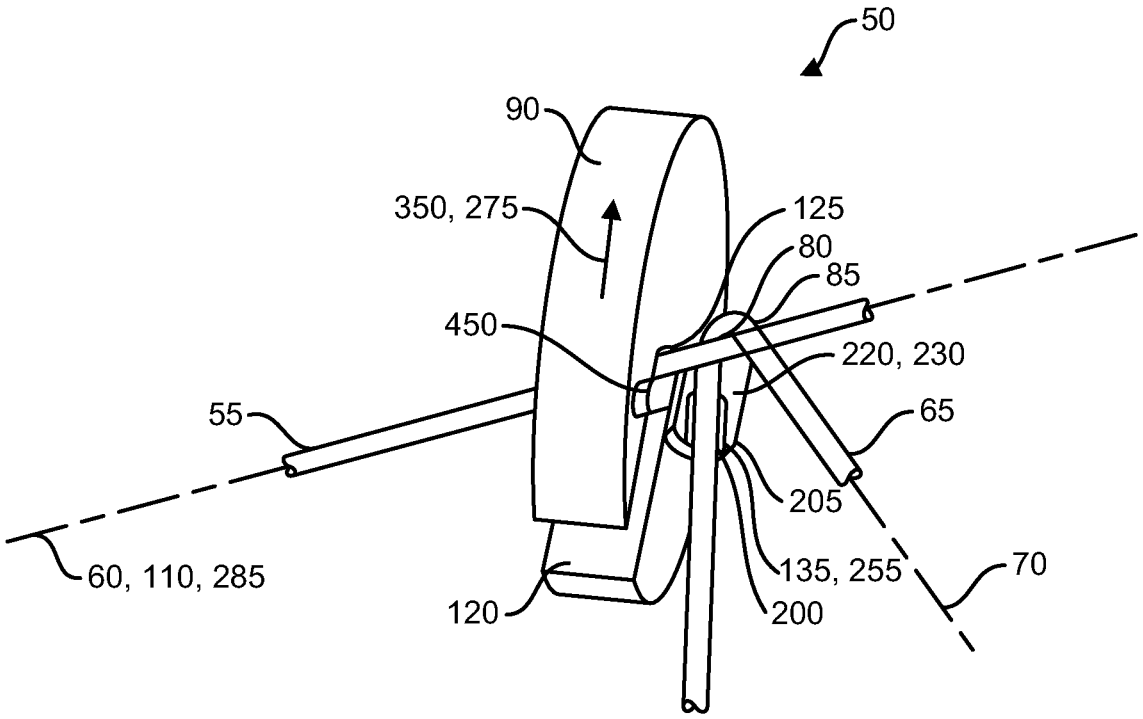
FIG. 28 shows an upper perspective view of the article bender apparatus in a fifth use step of further continuing to engage in rotational movement of the disc thus further continuing the selected helical wrap of the second line about the first line, note that for pictorial clarity the ratchet, receptacle, and receptacle handle are not shown.

In addition, FIG. 28 shows an upper perspective view of the article bender apparatus 50 in a fifth use step of further continuing to engage in rotational movement 385 of the disc 90 thus further continuing the selected helical wrap 85 of the second line 65 about the first line 55, note that for pictorial clarity the ratchet 355, receptacle 356, and receptacle 356 handle 345 are not shown.

Figure 29:
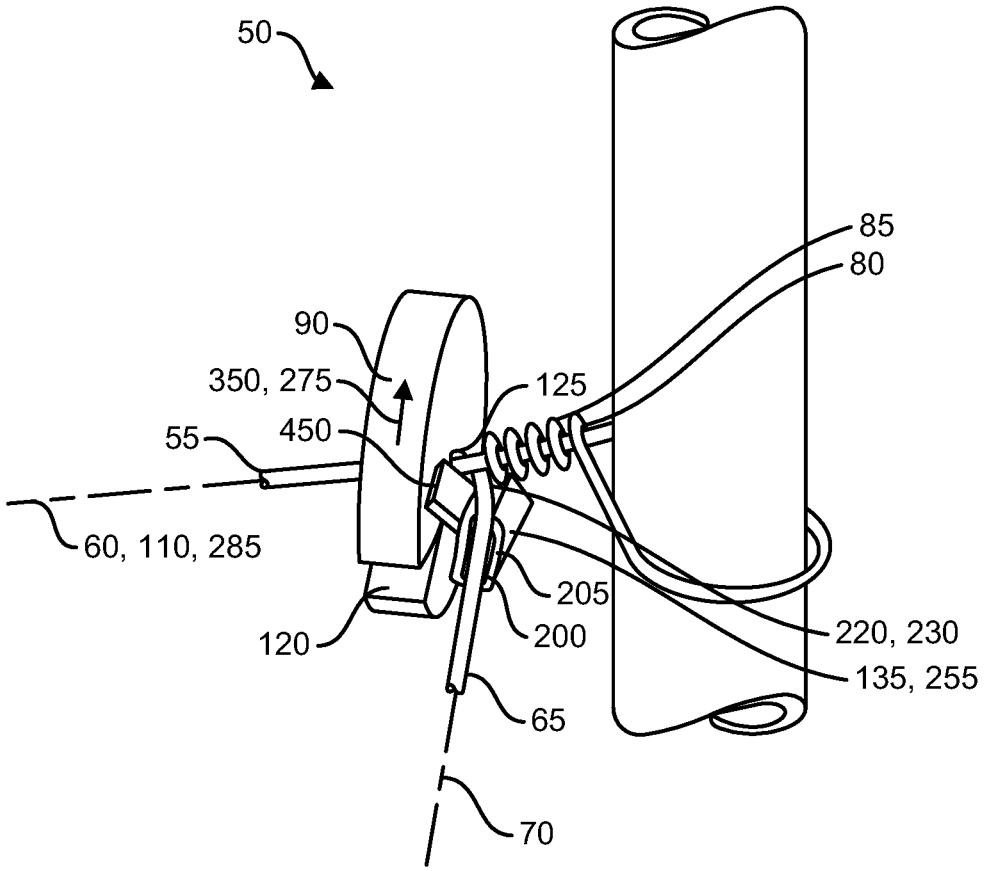
FIG. 29 shows an upper perspective view of the article bender apparatus in a sixth use step of further continuing to engage in rotational movement of the disc thus further continuing the selected helical wrap of the second line about the first line resulting in multiple helical wraps of the second line about the first line, note that for pictorial clarity the ratchet, receptacle, and receptacle handle are not shown.

Next, FIG. 29 shows an upper perspective view of the article bender apparatus 50 in a sixth use step of further continuing to engage in rotational movement 385 of the disc 90 thus further continuing the selected helical wrap 85 of the second line 65 about the first line 55 resulting in multiple helical wraps 85 of the second line 65 about the first line 55, note that for pictorial clarity the ratchet 355, receptacle 356, and receptacle 356 handle 345 are not shown.

Figure 30:
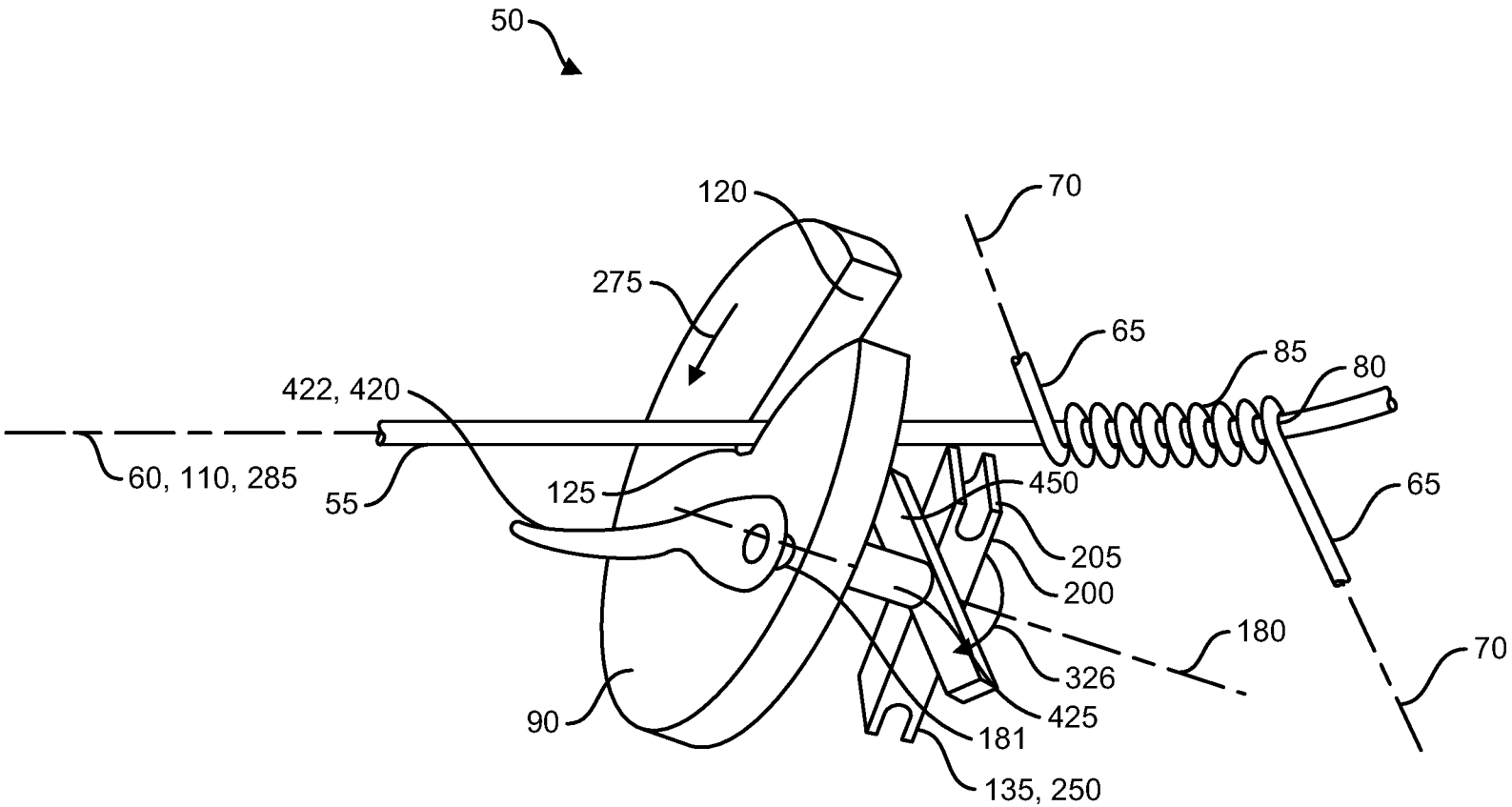
FIG. 30 shows an upper perspective view of the article bender apparatus in a final use step of the second line terminating therethrough the first channel of the shoe and retainer bar thus ending the selected helical wrap of the second line about the first line, wherein the shoe and retainer bar is moved from the closed operational state to the open operational state of the cam lock clamp with quick release handle resulting in axial looseness of the pivot bolt to enable the first line to be removed from the disc slot root section, with the flat spring (not shown) in the same state as shown in FIG. 22, this in FIG. 30 shown is removing the article bender apparatus from the first line, note that for pictorial clarity the ratchet, receptacle, and receptacle handle are not shown.

Further, FIG. 30 shows an upper perspective view of the article bender apparatus 50 in a final use step of the second line 65 terminating therethrough the first channel 200 of the shoe 135 and retainer bar 450 thus ending the selected helical wrap 85 of the second line 65 about the first line 55. Wherein in FIG. 30 the shoe 135 and retainer bar 450 is moved from the closed operational state 255, 421 to the open operational state 250, 422 of the cam lock clamp 420 with quick release handle resulting in axial looseness 422 of the pivot bolt 425 to enable the first line 55 to be removed from the disc 90 slot 120 root section 125, with the flat spring 430 (not shown) in the same state as shown in FIG. 22. Thus, in FIG. 30 shown is removing of the article bender apparatus 50 from the first line 55, note that for pictorial clarity the ratchet 355, receptacle 356, and receptacle 356 handle 345 are not shown.

Figure 31:
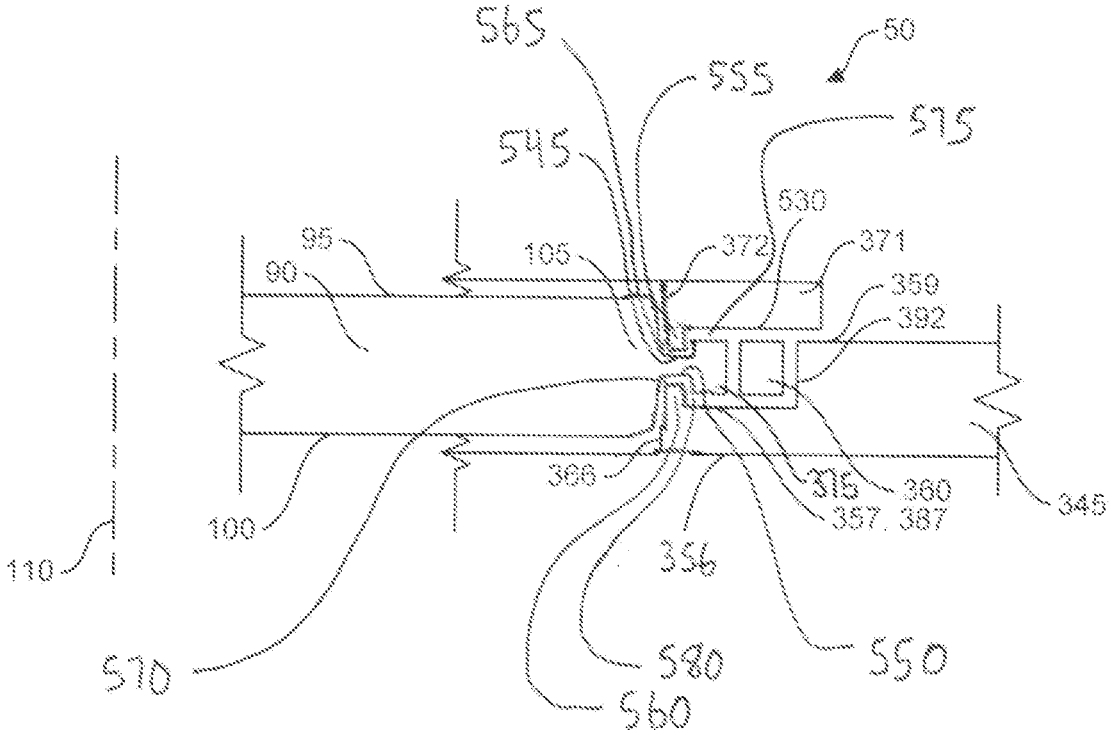

Continuing, FIG. 31 is taken from cross section 31-31 from FIG. 17, wherein FIG. 31 shows the disc 90 that is rotationally slidably engaged 357 in the receptacle 356 with the pawl 360 shown in conjunction with the cover ring 371, wherein the pawl 360 shows the ratchet 355 in the second operational state 405 with the pawl 360 asymmetrical gear teeth 361 disengaged to the disc 90 outer periphery 105 and asymmetrical gear teeth 375 thus allowing free rotation 350/351 of the receptacle handle 345 counterclockwise about the longitudinal axis 110 and the disc 90 free rotation clockwise 385 about the longitudinal axis 110, wherein the pawl 360 is moved away from the arcuate convergence 389 (see FIG. 18) against the means for biasing 391 the pawl 360 by the aforementioned relative asymmetrical gear teeth 361 movement 401 of the pawl 360 and disc 90.

Figure 32:
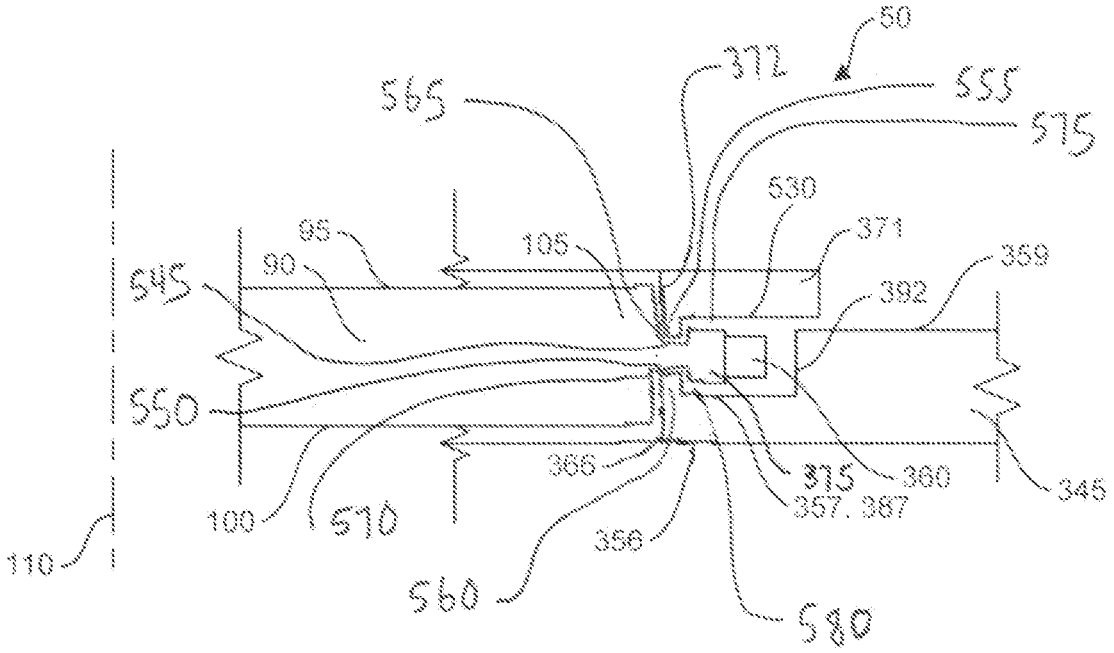

Next, FIG. 32 is taken from cross section 32-32 from FIG. 16, wherein FIG. 32 shows the disc 90 that is rotationally slidably engaged in the receptacle 356 with the pawl 360 shown in conjunction with the cover ring 371, wherein the disc 90 outer periphery 105 and asymmetrical gear teeth 375 are slidably engaged with the slide surface 357 and the radial internal diameter 372 plus the internal diameter to have the disc 90 retained within the receptacle 356 while allowing free clockwise rotation 385 about the longitudinal axis 110, also shown in FIG. 32 is the pawl 360 asymmetrical gear teeth 361 engaged to the disc 90 outer periphery 105 and asymmetrical gear teeth 375 thus forming the first operational state 400 of the ratchet 355.

Figure 33:
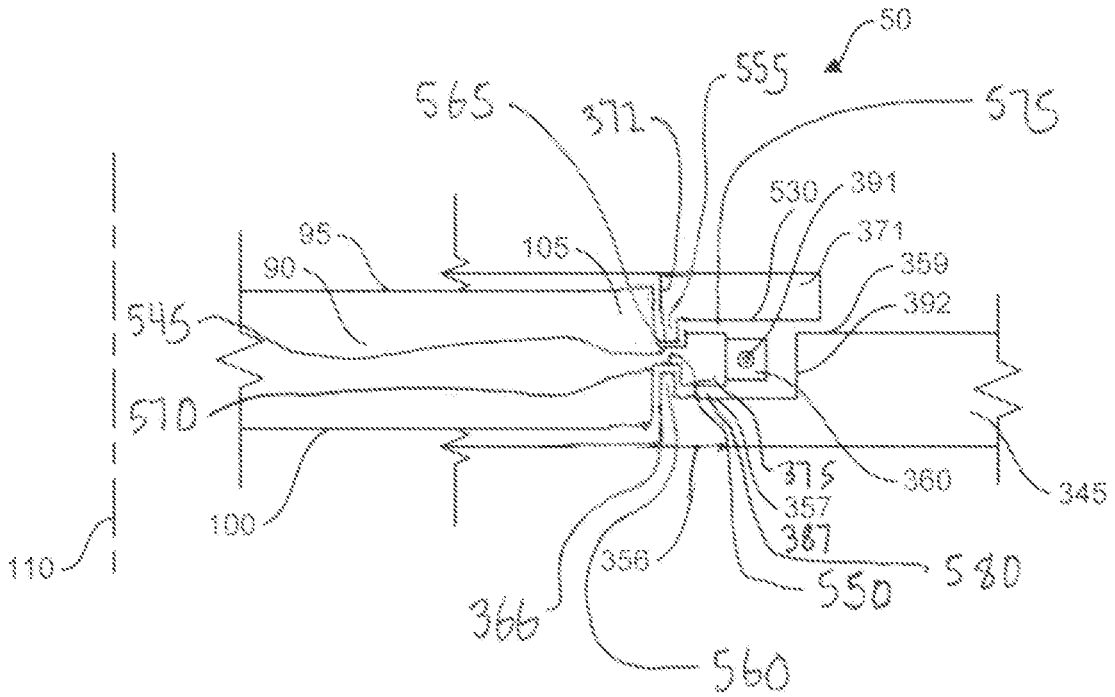

Further, FIG. 33 is taken from cross sections 33-33 from FIGS. 16 and 17, wherein FIG. 33 shows the disc 90 that is rotationally slidably engaged in the receptacle 356 with the pawl 360 shown in conjunction with the cover ring 371 and more particularly the means 391 for biasing the pawl 360 toward the arcuate convergence 389 (see FIG. 18) wherein the means 391 is preferably a spring, wherein FIG. 33 shows the disc 90 outer periphery 105 and asymmetrical gear teeth 375 are slidably engaged with the slide surface 357 and the radial internal diameter 372 plus the internal diameter to have the disc 90 retained within the receptacle 356 while allowing free clockwise rotation 385 about the longitudinal axis 110, also shown in FIG. 33 is the pawl 360 asymmetrical gear teeth 361 engaged to the disc 90 outer periphery 105 and asymmetrical gear teeth 375 thus forming the first operational state 400 of the ratchet 355.

Broadly in referring to FIGS. 1 to 33 the article bender apparatus 50 is disclosed that assists in joining two separate malleable article line free ends that are defined as a first line free end portion 55 with a first line long axis 60 and a second line free end portion 65 with a second line long axis 70 when the first 60 and second 70 line long axes are positioned substantially perpendicular 75 to one another, the article bender apparatus 50 assists in joining 80 the first 55 and second line 65 free end portions in a selected helical wrap 85, see FIGS. 22 to 30. The article bender apparatus 50 including the disc 90 having a first face portion 95 and an opposing second face portion 100, further the disc 90 having an outer periphery portion 105 that is about a longitudinal axis 110 that is centered in the disc 90, wherein the longitudinal axis 110 is positioned perpendicular 115 to both the first 95 and second 100 face portions. In addition, the disc 90 has a slot 120 disposed therethrough from the first face portion 95 to the second face portion 100, wherein the slot 120 originates from the longitudinal axis 110 in a root section 125 then extending in a radial fashion 130 to the outer periphery portion 105, the outer periphery portion 105 further includes a plurality of asymmetrical gear teeth 270, 375 extending radially outward, see in particular, FIGS. 1 to 10 and 16 to 30.

Further included in the article bender apparatus 50 is the receptacle housing 356 that includes a radially slotted 367 annular cavity having the slide surface 357 and the radial internal diameter 358 that both provide a partially nested axial and outer periphery slidable contact for the plurality of asymmetrical gear teeth 375 extending radially outward on the outer periphery portion 105 of the disc 90, a radial slot 367 is disposed therethrough the annular cavity, thus the receptacle housing 356 operationally allowing for free disc rotation 385, 390 about the longitudinal axis 110.

The receptacle housing 356 also includes a top surface 359 approximately in the form of a ring that is parallel to the slide surface 357 and is positioned radially outward of the radial internal diameter 358, the receptacle housing 356 additionally includes a recessed cavity 386 with the floor 387 wherein the recessed cavity 386 floor 387 is in plane with the slide surface 357. Further the recessed cavity 386 extends radially outward from the slide surface 357 for circumferentially a portion of the plurality of asymmetrical gear teeth 375 on the disc 90, further the top surface 359 extends outward from the recessed cavity 386 as the top surface 359 is continuously outward of the plurality of asymmetrical gear teeth 375 on the disc 90 and the recessed cavity 386, see FIGS. 1 to 21.

Further included in the article bender apparatus 50 is the pawl element 360 that is substantially planar including the first side 364 and an opposing second side 365 that are both planar in shape, further the pawl 360 includes a primary boundary margin 403 and a secondary 404 boundary margin that are both disposed as between the first 364 and second 365 sides of the pawl 360. The pawl 360 also includes a plurality of asymmetrical gear teeth 361 disposed opposite of the primary 403 and secondary 404 boundary margins, the pawl 360 plurality of asymmetrical gear teeth 361 removably mate, through the pawl 360 second side 365 sliding against the recessed cavity 386 floor 387, with the disc 90 outer periphery portion 105 plurality of asymmetrical gear teeth 375 extending radially outward, resulting in the pawl 360 being slidably disposed within the recessed cavity 386 with the pawl 360 second side 365 being in the slidable contact with the recessed cavity 386 floor 387.

Wherein the receptacle 356, the disc 90 outer periphery portion 105 plurality of asymmetrical gear teeth 375 extending radially outward, and the pawl 360 plurality of asymmetrical gear teeth 361 that removably mate with the disc 90 outer periphery portion 105 plurality of asymmetrical gear teeth 375, form a ratchet 355 that operationally facilitates clockwise rotation 385 of the disc 90 and receptacle 356 in unison about the longitudinal axis 110 and facilitates counter clockwise rotation 351 of the receptacle 356 about the longitudinal axis 110 while the disc 90 is either static rotationally or the receptacle 356 is static rotationally and the disc 90 can be manually rotated clockwise 385 about the longitudinal axis 110, see FIGS. 1 to 21.

Further included in the article bender apparatus 50 is a shoe 135 that is planar 140 in shape having a primary planar face portion 145 and an opposing secondary planar face portion 150, the shoe 135 has a lengthwise axis 155 and a perpendicularly positioned 165 shortwise axis 160, the shoe 135 has a first end portion 170 and an opposing second end portion 175 with the lengthwise axis 155 spanning therebetween. Further, the shoe 135 has an axial axis 180 that is perpendicular 185 to both the lengthwise 155 and shortwise 160 axes, wherein the axial axis 180 spans between the primary 145 and secondary 150 planar face portions also the axial axis 180 is positioned parallel 190 to the disc 90 longitudinal axis 110. With the primary planar face portion 145 having a slidable/pivotal engagement 195 to the disc 90 second face portion 100, about the axial axis 180, the shoe 135 first end portion 170 terminates in a first channel 200 that is positioned longwise to be parallel 235 to the shortwise axis 160, see in particular, FIGS. 4 to 15 and 22 to 30.

Additionally included in the article bender apparatus 50 is a means 240 for a selectable pivotal lock with pivotal movement 245 between the disc 90 and the shoe 135, the pivotal lock is about the axial axis 180, wherein the shoe 135 is an open operational state 250 when the slot 120 is fully open and the shoe 135 is in a closed locked operational state 255 when the shoe 135 partially covers the slot 120 leaving the slot root section 125 open, see FIGS. 1 to 15 and 22 to 30.

Also included in the article bender apparatus 50 is a means 270 for imparting a clockwise rotational movement 385 to the receptacle 356, wherein the rotational movement 275, 385 is about the longitudinal axis 110, wherein operationally the disc 90 is inserted 280 onto the first line free end portion 55 with the first line long axis 60 therethrough the disc 90 slot 120 from the outer periphery portion 105 to the root section 125 resulting in the longitudinal axis 110 and the first line long axis 60 being substantially co-incident 285 to one another, next the shoe 135 is manually moved 290 through the pivotal movement 245 from the open state 250 to the closed locked state 255 resulting in the first line free end portion 55 being secured within the root section 125. Continuing simultaneously during the shoe 135 being manually moved 295 the first channel 200 is aligned to partially encompass the second line free end portion 65, resulting in both the first line free end portion 55 being secured within the root section 125 and the shoe 135 first channel 200 to partially encompass the second line free end portion 65, next the imparting of rotational movement 275, 385 to the disc 90 is initiated to result in the selected helical wrap 85 of the second line free end portion 65 around the first line free end portion 55 being about the first line long axis 60, see FIGS. 22 to 30.

As an option for the article bender apparatus 50, wherein the shoe 135 further comprises a first ridge 205 that is disposed between the first channel 200 and the adjacent primary planar face portion 145 wherein the first ridge 205 forms an acute angle 210 between the shortwise axis 160 and the first ridge 205 to operationally add clearance 220 for an adjacent immediately prior helical wrap 85, see FIGS. 4 to 15 and 22 to 30.

Another option for the article bender apparatus 50, wherein the shoe 135 first ridge 205 in conjunction with the first channel 200 are positioned along the shoe 135 axial axis 180 to be closer 225 to the secondary planar face portion 150 than to the primary planar face portion 145 to operationally create clearance 230 for the adjacent second line free end portion 65 to the shoe 135 as the disc 90 rotates 275, 385 with the rotational movement 275 about the longitudinal axis 110 and the first line 55 long axis 60 in creating the helical wrap 85, see FIGS. 4 to 15 and 22 to 30.

Another further option for the article bender apparatus 50, the pawl 360 primary boundary margin 403 is a constant arc radius defined by a third radius 394 originating at the longitudinal axis 110 and the pawl 360 secondary boundary margin 404 is a decreasing arc radius defined by a decreasing fourth radius 395 originating at the longitudinal axis 110. The recessed cavity 386 extends radially outward from the slide surface 357 that forms a slide surface 357 consistent termination margin 388 at a first radius 392 originating at the longitudinal axis 110 to form a consistent operational gap width 396 between the primary boundary margin 403 and the slide surface consistent termination margin 388.

The consistent operational gap width 396 is at least equal to a tooth height 398 of the asymmetrical gear teeth 375 on the disc 90 with the pawl 360 plurality of asymmetrical gear teeth 361 removably mated with the disc 90 outer periphery portion 105 plurality of asymmetrical gear teeth 375, further the recessed cavity 386 extends radially outward from the slide surface 357 that forms a slide surface converging termination margin 389 at a second decreasing radius 393 originating at the longitudinal axis 110 to form a converging operational gap width 397 between the secondary boundary margin 404 and the slide surface 357 converging termination margin 389.

Wherein the consistent 388 and converging 389 termination margins combine to be circumferentially a portion of the plurality of asymmetrical gear teeth 375 on the disc 90, further the top surface 359 extends outward from the recessed cavity 386 consistent 388 and converging 389 termination margins as the top surface 359 is continuously outward of the plurality of asymmetrical gear teeth 375 on the disc 90 and the recessed cavity 386, see FIGS. 16 to 21.

Alternatively, for the article bender apparatus 50, it can further comprise a cover ring 371 that is partially attached to the receptacle 356 top surface 359 wherein the cover ring 371 also includes an inward internal diameter surface 366 that is positioned co-axial and coincident diameter wise to the radial internal diameter surface 358 to encapsulate on three sides the plurality of asymmetrical gear teeth 375 extending radially outward from the outer periphery portion 105 of the disc 90. Further the cover ring 371 encapsulates the recessed cavity 386 to operationally substantially limit the pawl 360 to slidable movement 401, 402 within the recessed cavity 386 to the pawl 360 plurality of asymmetrical gear teeth 361 to removably mate with the disc 90 outer periphery portion 105 plurality of asymmetrical gear teeth 375, wherein ultimately operationally allowing for free disc 90 clockwise rotation 385 about the longitudinal axis 110 within the receptacle 356 and the cover ring 371, see FIGS. 16 to 21.

Further, alternatively for the article bender apparatus 50, it can further comprise a means 391 for biasing the pawl 360 toward the converging operational gap width 397 within the recessed cavity 386, operationally the means 391 for biasing the pawl 360 results in defaulting with movement 401 the pawl 360 into a first operational state 400 to engage the plurality of asymmetrical gear teeth 361, 375 as between the pawl 360 and the disc 90 thus resulting in the ratchet 355 rotationally locking the receptacle 356 and the disc 90 rotationally about the longitudinal axis 110 in a clockwise direction rotation 385. If the receptacle 356 is rotated about the longitudinal axis 110 in a counterclockwise direction 350 rotation with the disc 90 rotationally locked, the disc 90 plurality of asymmetrical gear teeth 375 will drive the pawl 360 against the means 391 for biasing the pawl 360, sliding 402 the pawl 360 away from the converging operational gap width 397 toward the consistent operational gap width 396 to facilitate the plurality of asymmetrical gear teeth 361, 375 as between the pawl 360 and the disc 90 to disengage 402 thus resulting in the pawl 360 being in a second operational state 405, see FIGS. 16 to 21.

Further, alternatively for the article bender apparatus 50, the means 391 for biasing the pawl 360 is constructed of a spring, see FIGS. 16 to 18.

Continuing, alternatively for the article bender apparatus 50, wherein the means 240 for the selectable pivotal lock is preferably constructed of a cam lock clamp 420 with a quick release handle with the pivot bolt 425, wherein when the cam lock clamp 420 with a quick release handle is in a locked or closed operational state 421 when the pivot bolt 425 is pulled axially tight as between the disc 90 and the shoe 135 along the axial axis 180 of the shoe 135. Wherein the pivot bolt 425 is disposed therethrough the disc 90 and the shoe 135 in a shoe aperture 181, the locked or closed operational state 421 of the cam lock clamp 420 with a quick release handle results in the cam lock clamp 420 with a quick release handle. Wherein the handle 420 is positioned to be adjacent 421 to the disc 90 first face portion 95, wherein when the cam lock clamp 420 with a quick release handle is in the open or released operational state 422 the pivot bolt 425 is released to be loose axially allowing the disc 90 and the shoe 135 to separate with the handle 420 being positioned perpendicular to the disc 90 first face portion 95, see FIGS. 1 to 12 and 22 to 30.

Another alternative for the article bender apparatus 50, wherein the means 270 for imparting clockwise rotational movement to the receptacle 356 is constructed of a handle 345 extension that is positioned radially outward from the receptacle housing 356, wherein operationally the handle 345 extension partially rotates the receptacle housing 356 about the longitudinal axis 110 to operate the ratchet 355 to rotate the disc 90 in a clockwise rotational direction 385, see FIGS. 1 to 4.

A further option for the article bender apparatus 50, wherein the shoe can further include the retainer bar 450 that shares the pivot bolt 425 with the shoe 135 along and about the axial axis 180, wherein the retainer bar 450 is disposed between the shoe 135 and the disc 90 second face portion 100 at a displaced pivotal angle to the shoe 135 lengthwise axis 155. Wherein operationally the retainer bar 450 contacts the first line free end portion 55 within the root section 125 of the slot 120 when the shoe 135 is in a closed locked operational state 255, 421, further included is a stop pin 455 disposed in the disc 90 second face portion 100 that protrudes in a perpendicular manner, wherein the stop pin 455 stops a pivotal movement 245 of the shoe 135 and retainer bar 450 about the axial axis 180 in the shoe 135 open operational state 250, 422 to help pivotally 245, 260, 290, position the first channel 200 to the second line free end portion 65, to start the selected pivotal wrap 85, see FIGS. 4, 5, 8, 9 to 14, and 22 to 30.

Another option for the article bender apparatus 50, can further comprise the flat spring 430 with an arcuate shape forming an arcuate band that is mounted in a cantilever manner on a pivot rod 435 that is disposed therethrough a flat spring aperture 445 disposed in the disc 90 going from the second face portion 100 to the first face portion 95, wherein as the flat spring 430 is on the second face portion 100 the pivot rod 435 is attached to a flat spring handle 440 that manually facilitates flat spring 430 pivotal movement 460. Wherein operationally, the flat spring 430 acts to help hold the second line free end portion 65 into the shoe 135 first channel 200 for the shoe 135 to start the selected helical wrap 85 of the second line free end portion 65 being helically wrapped 85 about the first line 55, see FIGS. 5 to 10 and 22-30.

A further option for the article bender apparatus 50, is wherein the flat spring handle 440 can further comprise the spring ball protrusion 465 that is disposed to face the disc 90 first face portion 95, wherein the disc 90 first face portion 95 can also further include the receiving depression 470 that is positioned, sized, and configured to receive the spring ball protrusion 465 to operationally lock the flat spring handle 440 at a particular flat spring 430 pivotal movement 460 position to best operationally hold the second line free end portion 65 into the shoe 135 first channel 200 for the shoe 135 to start the selected helical wrap 85 of the second line free end portion 65 being helically wrapped 85 about the first line 55, see FIGS. 5 to 10 and 22 to 30.

Also, optionally for the article bender apparatus 50, wherein the disc 90 can further comprise the finger hole aperture 415 disposed therethrough the disc 90 from the first face portion 95 to the second face portion 100 to operationally facilitate manual rotational movement 385, 390 of the disc 90 within the receptacle 356 about the longitudinal axis 110 to help a user rotationally align the disc 90 slot 120 to the receptacle slot 367 or the shoe 135 first channel 200 with the first 55 or second 65 lines to initiate use of the article bender apparatus 50, see FIGS. 1 to 4 and 22 to 30.

The cover ring 371 has an inner surface 372 that is in contact with the receptacle 356 top surface 359, wherein the cover ring 371 inner surface 372 can be smooth and the recessed cavity 386 floor 387 is smooth ensuring that operationally the pawl 360 sliding against the recessed cavity 386 floor 387 and the cover 371 inner surface 372 is only limited by the slide surface 357 converging termination margin 393, and the slide surface 357 consistent termination margin 388, see FIGS. 16, 17, 18, 20, 31, 32, and 33.

The disc 90 outer periphery portion 105 can further comprise a first annular channel 545 disposed in the first face portion 95, wherein the first annular channel 545 is positioned in a juxtapose manner to a plurality of gear tooth 375 roots, further the cover ring 371 has a first annular protrusion 555 disposed between a cover ring 371 inner surface and the internal diameter surface 372 of the cover ring 371, wherein the first annular protrusion 555 projects toward the slide surface 387 of the receptacle 356. Wherein operationally, the first annular protrusion 555 is slidably received 565 by the first annular channel 545 to rotationally 275 support the disc 90 in the receptable 356 facilitating a lubricant disposed in a first gap 575 to hold the disc 90 axially along the longitudinal axis 110, the first gap 575 is positioned between the clockwise asymmetrical gear teeth 375 and an inner surface 372 of the cover ring 371, see FIGS. 16, 17, 18, 20, 31, 32, and 33.

The handle extension 345 can be constructed of a mounting stub 525 that is affixed to the receptable 356, wherein the mounting stub 525 has an interface with the handle extension 345, further a means 520 for affixing the handle extension 345 to the mounting stub 525 to operationally facilitate a lighter in weight handle extension 345 that can have a selected radially outward extension length 535 and a hand grip aperture inner boundary 540 configuration, see FIGS. 1 to 4.

The disc can further comprise a pair of finger hole apertures 415, wherein one finger hole aperture 415 is positioned to straddle the quick release handle 345, when the quick release handle 345 is in the closed operational state, see FIG. 1, and another finger hole aperture 415 is positioned on the disc 90 to be substantially opposite of the quick release handle 345 in relation to the longitudinal axis 110, when the quick release handle 345 is in the closed operational state in relation to the longitudinal axis 110, to operationally facilitate a two finger manual rotational movement 275 of the disc 90 creating a rotational moment 275 about the longitudinal axis 110 of the disc 90 within the receptacle 356 about the longitudinal axis 110 to help a user rotationally 275 align the disc slot 120 with the receptacle 356 slot 367 or the shoe 135 first channel 200 with the first 55 or second 65 lines to initiate use of said article bender apparatus 50, see FIGS. 1 to 3.

The disc 90 outer periphery portion 105 can further comprise a second annular channel 550 disposed in the second face portion 100, wherein the second annular channel 550 is positioned in a juxtapose manner to a plurality of gear tooth 375 roots, further the receptacle housing 356 has a second annular protrusion 560 disposed between the slide surface 357 and the internal diameter surface 366 of the receptacle 356, wherein the second annular protrusion 560 projects toward the top surface 359. Wherein operationally, the second annular protrusion 560 is slidably received 570 by the second annular channel 550 to rotationally 275 support the disc 90 in the receptable 356 facilitating a lubricant to be disposed in a second gap 580 to hold the disc 90 axially along the longitudinal axis 110, the second gap 580 is positioned between said clockwise asymmetrical gear teeth 375 and the slide surface 357 of the receptacle 356, see FIGS. 16, 17, 18, 20, 31, 32, and 33.

50 Article bender apparatus
55 First line free end portion
60 First line long axis of the first line free portion 55
65 Second line free end portion
70 Second line long axis of the second line free portion 65
75 Perpendicular position of the first 60 and second 70 line long axes
80 Joining the first 55 and second 65 line free end portions
85 Selected helical wrap of the second line free end portion 65 around the first line free end portion 55
90 Disc
95 First face portion of the disc 90
100 Second face portion of the disc 90
105 Outer periphery portion of the disc 90
110 Longitudinal axis of the disc 90
120 Slot of the disc 90
125 Root section of the slot 120
130 Radial fashion extension of the slot 120
135 Shoe
140 Planar shape of the shoe 135
145 Primary planar face portion of the shoe 135
150 Secondary planar face portion of the shoe 135
155 Lengthwise axis of the shoe 135
160 Shortwise axis
165 Perpendicular position of the lengthwise axis 155 to the shortwise axis 160
170 First end portion of the shoe 135
175 Second end portion of the shoe 135
180 Axial axis of the shoe 135
181 Shoe aperture that is disposed in the disc 90 and the shoe 135
185 Perpendicular position of the axial axis 180 and both the lengthwise 155 and shortwise 160 axes
200 First channel of the shoe 135
205 First ridge of the shoe 135
210 Acute angle between the shortwise axis 160 and the first ridge 205
220 Clearance added to the prior adjacent helical wrap 85
225 Closer position of the first channel 200 and first ridge 205 to the secondary planar face portion 150 than to the primary planar face portion 145
230 Creating clearance for the adjacent second line free end portion 65 to the shoe 135 as it is rotating with the disc 90
235 Parallel position of the first channel 200 longwise to the shortwise axis 160
240 Means for a selectable pivotal lock
245 Pivotal movement between the disc 90 and the shoe 135 and the retainer bar 450
250 Shoe open operational state when the disc 90 slot 120 is fully open
255 Shoe closed operational state with locked pivotal movement 245 of the shoe 135 partially covering the disc 90 slot 120 leaving the slot root section 125 open
260 Shoe 135 and the retainer bar 450 rotation about the axial axis 180
270 Means for imparting rotational movement 275 to the disc 90 and receptacle 356 about the longitudinal axis 110
275 Rotational movement of the disc 90
280 Inserting the disc 90 onto the first line free end portion 55 therethrough the disc 90 slot 120 from the outer periphery portion 105 to the root section 125
285 Co-incident position of the disc 90 longitudinal axis 110 to the first line long axis 60
290 Manually moving the shoe 135 and the retainer bar 450 through the pivotal movement 245 from the open state 250 to the closed locked state 255 to secure the first line free end portion 55 within the root section 125
295 Simultaneously moving the shoe 135 and the retainer bar 450 to position and align the first channel 200 to partially encompass the second line free end portion 65 being in the closed operational state 255
326 Manually moving the shoe 135 and the retainer bar 450 through the pivotal movement 245 from the closed and locked operational state 255 to the open operational state 250 to release the first line free end portion 55 from the root section 125 and slot 120
345 Handle extending radially outward from the receptacle 356
350 Manual load movement of the handle 345/disc 90 that rotates 385 the shoe 135 in lockstep via the ratchet 270/275
351 Manual free movement of the handle 345 from the ratchet 270/275
355 Ratchet that is basically defined by the pawl 360 asymmetrical gear teeth 361, the disc 90 outer periphery 105 asymmetrical gear teeth 375, and the receptacle 356
356 Receptacle for the disc 90 that is slidably rotationally freely movable that retains the disc 90 radially and on one side being the second face portion 100 axially while being rotationally free about the longitudinal axis 110
357 Slide surface of the receptacle 356 for the clockwise saw tooth interface 375 of the disc 90 outer periphery portion 105
358 Radial internal diameter of the receptacle 356 that provides a slidable outer radial containment for the clockwise saw tooth interface 375 of the disc 90 outer periphery portion 105
359 Top surface of receptacle 356 that is disposed on the outer periphery of the receptacle 356
360 Clockwise pawl with asymmetrical gear teeth that mate with the clockwise saw tooth interface 375 of the disc 90 outer periphery portion 105
361 Pawl asymmetrical gear teeth (or termed saw tooth or serrated teeth)
362 Short side of the pawl asymmetrical gear teeth 361
363 Long side of the pawl asymmetrical gear teeth 361
364 First side of the clockwise pawl 360
365 Second side of the clockwise pawl 360
366 Internal diameter surface of the receptacle 356
367 Radial slot of the receptacle 356

370 Saw tooth interface between the pawl 360 being the pawl asymmetrical gear teeth 361 and the clockwise asymmetrical gear teeth 375 resulting in rotationally locking the ratchet 355 to transmit clockwise rotation 385 to the disc 90 from the handle 345 and receptacle 356 about the longitudinal axis 110

371 Cover ring that axially retains the disc 90 on one side being the first face portion 95 axially while the disc 90 is being rotationally free about the longitudinal axis 110

372 Internal diameter surface of the cover ring 371

375 Clockwise asymmetrical gear teeth (or termed saw tooth or serrated teeth) interface of the disc 90 outer periphery portion 105

376 Short side of the clockwise asymmetrical gear teeth 375 (or termed saw tooth or serrated teeth) interface of the disc 90 outer periphery portion 105

377 Long side of the clockwise asymmetrical gear teeth 375 (or termed saw tooth or serrated teeth) interface of the disc 90 outer periphery portion 105

385 Clockwise rotational direction of the disc 90

386 Pawl 360 and spring 391 recessed cavity

387 Floor or slide surface of the recessed cavity 386

388 First arc boundary margin consistent radius portion from longitudinal axis 110

389 Second arc boundary margin decreasing radius portion defined as radius two 393 from longitudinal axis 110 forming an arcuate convergence as between the pawl 360 and the second arc boundary margin 389 as radius four 395 and radius two 393 converge toward one another thus decreasing gap 397 such that eventually the second arc boundary margin 389 and the radius four 395 come into contact with one another tightly wedging the pawl 360 between the second arc boundary margin 389 and the disc 90 outer periphery 105 clockwise asymmetrical gear teeth 375 of the receptacle 356 to lock the ratchet 355 to transmit clockwise rotation 385 to the disc 90 from the handle 345 and receptacle 356 about the longitudinal axis 110

390 Counterclockwise rotational direction of the disc 90

391 Means for biasing the pawl 360 toward the arcuate convergence 389 wherein the means 391 is preferably a spring

392 First radius or radius 1 one of the receptacle 356 that is consistent in distance from the longitudinal axis 110 that forms part of the recessed cavity 386 defined as the slide surface 387 termination margin

393 Second radius or radius 2 two of the receptacle 356 than is decreasing in distance from the longitudinal axis 110 that forms part of recessed cavity 386 defined as the slide surface 387 converging termination margin

394 Third radius or radius 3 three of the pawl 360 that is consistent in distance from the longitudinal axis 110 defined as the pawl 360 primary boundary margin

395 Fourth radius or radius 4 four of the pawl 360 that is decreasing in distance from the longitudinal axis 110 defined as the pawl 360 secondary boundary margin

396 Consistent operational gap width as between the consistent radius three 394 and the consistent radius one 392, wherein the operational gap 396 is disposed within the cavity 386, wherein the operational gap is consistent, however, changing as between the first operational state 400 of the ratchet 355 and the ratchet 355 in the second operational state 405

397 Converging operational gap width as between the radius four 395 and the radius two 393, wherein the operational gap 397 is shown as reducing in gap size as in converging, being disposed within the cavity 386

398 Tooth height of the short side 376 of the clockwise asymmetrical gear teeth 361, 375 (or termed saw tooth or serrated teeth) interface of the disc 90 outer periphery portion 105 or pawl 360 and the long side 377 of the clockwise asymmetrical gear teeth 361, 375 (or termed saw tooth or serrated teeth) interface of the disc 90 outer periphery portion 105 or pawl 350

400 First operational state of the ratchet 355 with the clockwise pawl 360 teeth 361 engaged to the disc 90 outer periphery portion 105 saw tooth clockwise tooth interface 375 that rotationally only allows clockwise disc rotation 385 in rotational lockstep with the receptacle 356, with the pawl 360 teeth 361 disengaged from the saw tooth interface 375 on the disc 90 outer periphery portion 105, the disc 90 can only rotate clockwise 385 independently from the receptacle 356

401 Pawl 360 movement to engage into the clockwise asymmetrical gear teeth 375 (or termed saw tooth or serrated teeth) interface of the disc 90 outer periphery portion 105 and the pawl 360 asymmetrical gear teeth 361 form the locking of the ratchet 355 to transmit clockwise rotation 385 to the disc 90 from the handle 345 and receptacle 356 about the longitudinal axis 110

402 Pawl 360 movement to disengage the clockwise asymmetrical gear teeth 375 (or termed saw tooth or serrated teeth) interface of the disc 90 outer periphery portion 105 and the pawl 360 asymmetrical gear teeth 361 form the unlocking of the ratchet 355 to allow free clockwise rotation 385 of the disc 90 within the receptacle 356 about the longitudinal axis 110

403 Primary boundary margin in a constant arc being radius three 394 of the pawl

404 Secondary boundary margin in a decreasing arc being radius four 395 of the pawl 360

405 Second operational state of the ratchet 355 with the pawl 360 teeth 361 disengaged to the disc 90 outer periphery 105 saw tooth counterclockwise tooth interface 375 that rotationally allows counterclockwise receptacle 356 movement 351 or complementary clockwise disc 90 rotation 385 with the pawl 360 teeth 361 disengaged from the disc 90 outer periphery portion 105 saw tooth interface 375

406 Means 391 extension of the pawl 360

415 Finger hole aperture in the disc 90 for manually rotating the disc 90 about the longitudinal axis 110 in clockwise rotation 385 of the disc 90 for alignment and positioning of the disc 90 slot 120, receptacle 356 slot 367, and the first line free end portion 55, note that counterclockwise rotation 390 of the disc 90 is prevented by the ratchet and pawl mechanism 355

420 Cam lock clamp with a quick release handle that pulls a pivot bolt 425 when the handle

421 Locked or closed operational state of the cam lock clamp 420 wherein the pivot bolt 425 is pulled axially tight forming a clamp similar to a common bicycle axle cam lock clamp, positionally the cam lock 420 handle is adjacent to the disc 90 first face portion 95 in the locked state 421

422 Open or released operational state of the cam lock clamp 420 wherein the pivot bolt 425 is released to be loose axially to open the clamp that is in closed state 421, wherein the cam lock 420 handle is moved away from to the disc 90 first face portion 95 to extend perpendicular to the to the disc 90 first face portion 95 in the released state 422

425 Axle axial pivot bolt of the cam lock clamp 420 that is about the axial axis 180 disposed therethrough said disc 90, retainer bar 450, and shoe 135 utilizing aperture shoe aperture 181

430 Flat spring with an arcuate shape

435 Pivot rod of the flat spring 430

440 Handle for the flat spring 430 and pivot rod 435

445 Flat spring aperture for the pivot rod 435 disposed within the disc 90

450 Retainer bar for the root section 125 of the slot 120

455 Stop pin for the retainer bar 450 pivotal movement that is about the axle axial pivot bolt 425, wherein the stop pin 455 is disposed within the disc 90, stop pin 455 is for the retainer bar 450 to stop only by virtue of a height limitation of the pin 455 extending from the disc 90 second face portion 100 with the stop pin 455 height only contacting the retainer bar 450, wherein the stop pin 455 is not high enough to contact the shoe 135

460 Pivotal movement manually of the flat spring 430 about the pivot rod 435 using the handle 440

465 Spring ball protrusion for the handle 440 for the purpose of locking the movement 460 of the flat spring 430 via the handle 440 into the disc 90 first face portion 95

466 Radius of the first channel 200 of the shoe 135

470 Receiving depression for the ball protrusion 465, wherein the receiving depression is disposed in the disc 90 first face portion 95

475 Acute angle between the lengthwise axis 155 and the first ridge 205

480 Chamfer radius disposed at the acute angle 475 on the first ridge 205

485 Chamfer radius disposed at the acute angle 210 on the first ridge 205 of the shoe 135

490 Chamfer radius at the first channel 200 of the shoe 135 approximately equal to the channel radius 466

491 Sidewall of the first channel 200

495 Channel 200 sidewall 491 chamfer that is approximately equal to one-half of the radius 466

500 Relief notch positioned at the trailing edge of the channel 220 that is operational to loosen the helical wrap 85 about the first line free end portion 55 for help with wire stress on the second line free end portion 65 and for help of the ease of manually creating the helical wrap 85 on the second line free end portion 65 by the user

505 Wide consistent operational gap 396 that is determined by tooth height 398 plus an operational clearance 515 as shown in FIG. 16 with the pawl 360 asymmetrical gear teeth 361 engaged to the disc 90 outer periphery 105 and asymmetrical gear teeth 375 thus forming the first operational state 400 of the ratchet 355

510 Narrow consistent operational gap 396 that is determined by wide operational gap 505 minus the tooth height 398 leaving only the operational clearance 515, wherein the ratchet 355 is in the second operational state 405 with the pawl 360 asymmetrical gear teeth 361 disengaged to the disc 90 outer periphery 105 and asymmetrical gear teeth 375 as shown in FIG. 17

515 Operational clearance is defined by the consistent operational gap 396 width that is at least equal to a tooth height 398 of the asymmetrical gear teeth 375 on the disc 90 is further limited to the tooth height 398 of the asymmetrical gear teeth 375 on the disc 90 plus an operating clearance 515 of about five to twenty percent of the tooth height 398 of the asymmetrical gear teeth 375 on the disc 90 to operationally prevent binding of the pawl 360 being slidably disposed 387 within the recessed cavity 386 from too little operating clearance 515 and to prevent the pawl 360 from allowing excessive of the counter clockwise rotational direction 390 of the disc 90 relative to the receptacle 356 prior to the pawl 360 plurality of asymmetrical gear teeth 361 removably mating with the disc 90 outer periphery portion 105 plurality of asymmetrical gear teeth 375 from too much operating clearance, see FIGS. 16, 17, 18, 20, 31, 32, and 33.

520 Means for affixing the handle 345 to the mounting stub 525

525 Mounting stub from the receptacle 356 to the handle 345

530 Inner surface of the cover ring 371

535 Extension length of the handle 345

540 Hand grip aperture inner boundary configuration

545 First annular channel disposed in first face portion 95 of disc 90

550 Second annular channel disposed in second face portion 100 of disc 90

555 First annular protrusion disposed on cover ring 371 as an extension of internal diameter 372

560 Second annular protrusion disposed on receptacle 356 as an extension of internal diameter 366

565 First slidable engagement between first annular channel 545 and the first annular protrusion 555

570 Second slidable engagement between second annular channel 550 and the second annular protrusion 560

575 First gap between the asymmetrical gear teeth 375 and the cover ring 371 inner surface 530

580 Second gap between the asymmetrical gear teeth 375 and the slide surface 357 of the receptacle 356

Accordingly, the present invention of the Article Bender Apparatus has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. An article bender apparatus that assists in joining two separate malleable article line free ends that are defined as a first line free end portion with a first line long axis and a second line free end portion with a second line long axis when said first and second line long axes are positioned substantially perpendicular to one another, said article bender apparatus assists in joining the first and second line free end portions in a selected helical wrap with the second line free end portion being helically wrapped about the first line, comprising:

a. a disc having a first face portion and an opposing second face portion, further said disc having an outer periphery portion that is about a longitudinal axis that is centered in said disc, wherein said longitudinal axis is positioned perpendicular to both said first and second face portions, in addition said disc has a slot disposed therethrough from said first face portion to said second face portion, wherein said slot originates from said longitudinal axis in a root section then extending in a radial fashion to said outer periphery portion, said outer periphery portion further includes a plurality of asymmetrical gear teeth extending radially outward;

b. a receptacle housing that includes a radially slotted annular cavity having a slide surface and a radial internal diameter that both provide a partially nested axial and outer periphery slidable contact for said plurality of asymmetrical gear teeth extending radially outward on said outer periphery portion of said disc, a radial slot is disposed therethrough said annular cavity, thus said receptacle housing operationally allowing for free disc rotation about said longitudinal axis, said receptacle housing also includes a top surface approximately in the form of a ring that is parallel to said slide surface and is positioned radially outward of said radial internal diameter, said receptacle additionally includes a recessed cavity with a floor wherein said recessed cavity floor is in plane with said slide surface, further said recessed cavity extends radially outward from said slide surface for circumferentially a portion of said plurality of asymmetrical gear teeth on said disc, further said top surface extends outward from said recessed cavity as said top surface is continuously outward of said plurality of asymmetrical gear teeth on said disc and said recessed cavity;

c. a pawl element that is substantially planar including a first side and an opposing second side that are both planar in shape, further said pawl includes a primary boundary margin and a secondary boundary margin that are both disposed as between said first and second sides of said pawl, said pawl also includes a plurality of asymmetrical gear teeth disposed opposite of said primary and secondary boundary margins, said pawl plurality of asymmetrical gear teeth removably mate, through said pawl second side sliding against said recessed cavity floor, with said disc outer periphery portion plurality of asymmetrical gear teeth extending radially outward, resulting in said pawl being slidably disposed within said recessed cavity with said pawl second side being in said slidable contact with said recessed cavity floor, wherein said receptacle, said disc outer periphery portion plurality of asymmetrical gear teeth extending radially outward, and said pawl plurality of asymmetrical gear teeth that removably mate with said disc outer periphery portion plurality of asymmetrical gear teeth, form a ratchet that operationally facilitates clockwise rotation of said disc and receptacle in unison about said longitudinal axis and facilitates counter clockwise rotation of said receptacle about said longitudinal axis while said disc is either static rotationally or said receptacle is static rotationally and said disc can be manually rotated clockwise about said longitudinal axis, wherein said pawl primary boundary margin is a constant arc radius defined by a third radius originating at said longitudinal axis and said pawl secondary boundary margin is a decreasing arc radius defined by a decreasing fourth radius originating at said longitudinal axis, said recessed cavity extends radially outward from said slide surface forms a slide surface consistent termination margin at a first radius originating at said longitudinal axis to form a consistent operational gap width between said primary boundary margin and said slide surface consistent termination margin, said consistent operational gap width is at least equal to a tooth height of said asymmetrical gear teeth on said disc with said pawl plurality of asymmetrical gear teeth removably mated with said disc outer periphery portion plurality of asymmetrical gear teeth, further said recessed cavity extends radially outward from said slide surface forms a slide surface converging termination margin at a second decreasing radius originating at said longitudinal axis to form a converging operational gap width between said secondary boundary margin and said slide surface converging termination margin, wherein said consistent and converging termination margins combine to be circumferentially a portion of said plurality of asymmetrical gear teeth on said disc, further said top surface extends outward from said recessed cavity consistent and converging termination margins as said top surface is continuously outward of said plurality of asymmetrical gear teeth on said disc and said recessed cavity, wherein said consistent operational gap width that is at least equal to a tooth height of said asymmetrical gear teeth on said disc is further limited to said tooth height of said asymmetrical gear teeth on said disc plus an operating clearance of about five to about twenty percent of said tooth height of said asymmetrical gear teeth on said disc to operationally prevent binding of said pawl being slidably disposed within said recessed cavity from too little operating clearance and to prevent said pawl from allowing excessive of said counter clockwise rotational direction of said disc relative to said receptacle prior to said pawl plurality of asymmetrical gear teeth removably mating with said disc outer periphery portion plurality of asymmetrical gear teeth from too much operating clearance;

d. a shoe that is planar in shape having a primary planar face portion and an opposing secondary planar face portion, said shoe has a lengthwise axis and a perpendicularly positioned shortwise axis, said shoe has a first end portion and an opposing second end portion with said lengthwise axis spanning therebetween, further said shoe has an axial axis that is perpendicular to both said lengthwise and shortwise axes, wherein said axial axis spans between said primary and secondary planar face portions also said axial axis is positioned parallel to said disc longitudinal axis with said primary planar face portion having a slidable/pivotable engagement to said disc second face portion about said axial axis, said shoe first end portion terminates in a first channel that is positioned longwise to be parallel to said shortwise axis;

e. a means for a selectable pivotal lock with pivotal movement between said disc and said shoe about said axial axis, wherein said shoe is in an open operational state when said slot is fully open and said shoe is in a closed locked operational state when said shoe partially covers said slot leaving said slot root section open; and f. a means for imparting a clockwise rotational movement to said receptacle, wherein said clockwise rotational movement is about said longitudinal axis, wherein operationally said disc is inserted onto the first line free end portion with the first line long axis therethrough said disc slot from said outer periphery portion to said root section resulting in said longitudinal axis and the first line long axis being substantially co-incident to one another, next said shoe is manually moved through said pivotal movement from said open state to said closed locked state resulting in the first line free end portion being secured within said root section, simultaneously during said shoe being manually moved said first channel is aligned to partially encompass the second line free end portion, resulting in both the first line free end portion being secured within said root section and said shoe first channel to partially encompass the second line free end portion, next said imparting of clockwise rotational movement to said disc is initiated to result in the selected helical wrap of the second line free end portion around the first line free end portion being about the first line long axis.

2. An article bender apparatus according to claim 1 wherein said shoe further comprises a first ridge that is disposed between said first channel and an adjacent said secondary planar face portion wherein said first ridge forms an acute angle between said shortwise axis and said first ridge to operationally add clearance for an adjacent immediately prior helical wrap.

3. An article bender apparatus according to claim 2 wherein said shoe first ridge in conjunction with said first channel are positioned along said shoe axial axis to be closer to said secondary planar face portion than to said primary planar face portion to operationally create clearance for the adjacent second line free end portion to said shoe as said disc rotates with said rotational movement about said longitudinal axis and the first line long axis in creating the helical wrap.

4. An article bender apparatus according to claim 1 further comprising a cover ring that is partially attached to said receptacle top surface wherein said cover ring also includes an inward internal diameter surface that is positioned coaxial and coincident diameter wise to said radial internal diameter surface to slidably encapsulate on three sides said plurality of asymmetrical gear teeth extending radially outward from said outer periphery portion of said disc, further said cover ring slidably encapsulates said recessed cavity to operationally substantially limit said pawl to slidable movement within said recessed cavity to said pawl plurality of asymmetrical gear teeth to removably mate with said disc outer periphery portion plurality of asymmetrical gear teeth, wherein ultimately operationally allowing for free disc clockwise rotation about said longitudinal axis within said receptacle and said cover ring.

5. An article bender apparatus according to claim 4 wherein said cover ring has an inner surface that is in contact with said receptacle top surface, wherein said cover ring inner surface is smooth and said recessed cavity floor is smooth ensuring that operationally said pawl sliding against said recessed cavity floor and said cover inner surface is only limited by said slide surface converging termination margin, and said slide surface consistent termination margin.

6. An article bender apparatus according to claim 5 wherein said disc outer periphery portion further comprises a first annular channel disposed in said first face portion, wherein said first annular channel is positioned in a juxtapose manner to a plurality of gear tooth roots, further said cover ring has a first annular protrusion disposed between a cover ring inner surface and said internal diameter surface of said cover ring, wherein said first annular protrusion projects toward said slide surface of said receptacle, wherein operationally said first annular protrusion is slidably received by said first annular channel to rotationally support said disc in said receptable facilitating a lubricant disposed in a first gap that is positioned between said clockwise asymmetrical gear teeth and an inner surface of said cover ring.

7. An article bender apparatus according to claim 5 further comprising a means for biasing said pawl toward said converging operational gap width within said recessed cavity, operationally said means for biasing said pawl results in defaulting said pawl into a first operational state to engage said plurality of asymmetrical gear teeth as between said pawl and said disc thus resulting in said ratchet rotationally locking said receptacle and said disc rotationally about said longitudinal axis in a clockwise direction rotation, if said receptacle is rotated about said longitudinal axis in a counterclockwise direction rotation with said disc rotationally locked, said disc plurality of asymmetrical gear teeth will drive said pawl against said means for biasing said pawl, sliding said pawl away from said converging operational gap width toward said consistent operational gap width to facilitate said plurality of asymmetrical gear teeth as between said pawl and said disc to disengage thus resulting in said pawl being in a second operational state.

8. An article bender apparatus according to claim 7 wherein said means for biasing said pawl is constructed of a spring.

9. An article bender apparatus according to claim 1 wherein said means for a selectable pivotal lock is constructed of a cam lock clamp with a quick release handle with a pivot bolt, wherein when said cam lock clamp with a quick release handle is in a locked or closed operational state said pivot bolt is pulled axially tight as between said disc and said shoe along said axial axis of said shoe, wherein said pivot bolt is disposed therethrough said disc and said shoe in a shoe aperture, said locked or closed operational state of said cam lock clamp with a quick release handle results in said cam lock clamp with a quick release handle, wherein said handle is positioned to be adjacent to said disc first face portion, wherein when said cam lock clamp with a quick release handle is in a open or released operational state said pivot bolt is released to be loose axially allowing said disc and said shoe to separate with said handle being positioned perpendicular to said disc first face portion.

10. An article bender apparatus according to claim 1 wherein said means for imparting clockwise rotational movement to said receptacle is constructed of a handle extension that is positioned radially outward from said receptacle housing, wherein operationally said handle extension partially rotates said receptacle housing about said longitudinal axis to operate said ratchet to rotate said disc in a clockwise rotational direction.

11. An article bender apparatus according to claim 10 wherein said handle extension is constructed of a mounting stub that is affixed to said receptable, wherein said mounting stub has an interface with said handle extension, further a means for affixing said handle extension to said mounting stub to operationally facilitate a lighter in weight handle extension that can have a selected radially outward extension length and a hand grip aperture inner boundary configuration.

12. An article bender apparatus according to claim 9 wherein said shoe further includes a retainer bar that shares said pivot bolt with said shoe along and about said axial axis, wherein said retainer bar is disposed between said shoe and said disc second face portion at a displaced pivotal angle to said shoe lengthwise axis, wherein operationally said retainer bar contacts the first line free end portion adjacent to said root section of said slot when said shoe is in a closed locked operational state, further included is a stop pin disposed in said disc second face portion that protrudes in a perpendicular manner, wherein said stop pin stops a pivotal movement of said shoe and retainer bar about said axial axis in said shoe closed operational state to help pivotally position said first channel of said shoe in relation to the second line free end portion to help start the selected helical wrap.

13. An article bender apparatus according to claim 12 further comprising a flat spring with an arcuate shape forming an arcuate band that is mounted in a cantilever manner on a pivot rod that is disposed therethrough a flat spring aperture disposed in said disc going from said second face portion to said first face portion, wherein as said flat spring is on said second face portion said pivot rod is attached to a flat spring handle that manually facilitates flat spring pivotal movement, wherein operationally said flat spring acts to help hold the second line free end portion into said shoe first channel for the shoe to start the selected helical wrap of the second line free end portion being helically wrapped about the first line.

14. An article bender apparatus according to claim 13 wherein said flat spring handle further comprises a spring ball protrusion that is disposed to face said disc first face portion, wherein said disc first face portion further includes a receiving depression that is positioned, sized, and configured to receive said spring ball protrusion to operationally lock said flat spring handle at a particular flat spring pivotal movement position to best operationally hold the second line free end portion into said shoe first channel for the shoe to start the selected helical wrap of the second line free end portion being helically wrapped about the first line.

15. An article bender apparatus according to claim 9 wherein said disc further comprises a finger hole aperture disposed therethrough said disc from said first face portion to said second face portion to operationally facilitate manual rotational movement of said disc within said receptacle about said longitudinal axis to help a user rotationally align said disc slot with said receptacle slot or said shoe first channel with the first or second lines to initiate use of said article bender apparatus.

16. An article bender apparatus according to claim 15 wherein said disc further comprises a pair of finger hole apertures, wherein one finger hole aperture is positioned to straddle said quick release handle, when said quick release handle is in said closed operational state, and another finger hole aperture is positioned on said disc to be substantially opposite of said quick release handle in relation to said longitudinal axis, when said quick release handle is in said closed operational state in said relation to said longitudinal axis, to operationally facilitate a two finger manual rotational movement of said disc creating a rotational moment about said longitudinal axis of said disc within said receptacle about said longitudinal axis to help a user rotationally align said disc slot with said receptacle slot or said shoe first channel with the first or second lines to initiate use of said article bender apparatus.

17. An article bender apparatus according to claim 1 wherein said disc outer periphery portion further comprises a second annular channel disposed in said second face portion, wherein said second annular channel is positioned in a juxtapose manner to a plurality of gear tooth roots, further said receptacle housing has a second annular protrusion disposed between said slide surface and said internal diameter surface of said receptacle, wherein said second annular protrusion projects toward said top surface, wherein operationally said second annular protrusion is slidably received by said second annular channel to rotationally support said disc in said receptable facilitating a lubricant disposed in a second gap that is positioned between said clockwise asymmetrical gear teeth and said slide surface of said receptacle.

* * * * *